US012253339B2

(12) United States Patent
Loehken

(10) Patent No.: US 12,253,339 B2
(45) Date of Patent: Mar. 18, 2025

(54) ADAPTER AND SHAPED CHARGE APPARATUS FOR OPTIMIZED PERFORATION JET

(71) Applicant: DynaEnergetics Europe GmbH, Troisdorf (DE)

(72) Inventor: Joern Olaf Loehken, Troisdorf (DE)

(73) Assignee: DynaEnergetics Europe GmbH, Troisdorf (DE)

( * ) Notice: Subject to any disclaimer, the term of this patent is extended or adjusted under 35 U.S.C. 154(b) by 53 days.

(21) Appl. No.: 17/971,708

(22) Filed: Oct. 24, 2022

(65) Prior Publication Data

US 2023/0131652 A1 Apr. 27, 2023

Related U.S. Application Data

(60) Provisional application No. 63/271,464, filed on Oct. 25, 2021.

(51) Int. Cl.

| | |
|---|---|
| ***F42B 1/024*** | (2006.01) |
| ***E21B 43/117*** | (2006.01) |
| ***F42B 1/02*** | (2006.01) |
| ***F42B 1/028*** | (2006.01) |

(52) U.S. Cl.

CPC ..... *F42B 1/024* (2013.01); *F42B 1/02* (2013.01); *F42B 1/028* (2013.01); *E21B 43/117* (2013.01)

(58) Field of Classification Search

CPC .. F42B 1/02; F42B 1/024; F42B 1/028; F42B 1/036; F42B 3/08; F42B 12/10; E21B 43/117

USPC ..... 102/306, 307, 309

See application file for complete search history.

(56) References Cited

U.S. PATENT DOCUMENTS

| | | | |
|---|---|---|---|
| 1,757,288 | A | 5/1930 | Bleecker |
| 2,062,974 | A | 12/1936 | Lane |
| 2,216,359 | A | 10/1940 | Spencer |
| 2,228,873 | A | 1/1941 | Hardt et al. |
| 2,296,346 | A | 9/1942 | Hearn |
| 2,358,466 | A | 9/1944 | Miller |
| 2,418,486 | A | 4/1947 | Smylie |
| 2,439,394 | A | 4/1948 | Lanzalotti et al. |
| 2,598,651 | A | 5/1952 | Spencer |
| 2,644,530 | A | 7/1953 | Baker |
| 2,667,836 | A | 2/1954 | Church et al. |

(Continued)

FOREIGN PATENT DOCUMENTS

| | | |
|---|---|---|
| AR | 021476 A1 | 7/2002 |
| AU | 2010217183 B2 | 6/2016 |

(Continued)

OTHER PUBLICATIONS

Machine translation of DE-3933955-A1 (Year: 1991).*

(Continued)

*Primary Examiner* — James S Bergin

(74) *Attorney, Agent, or Firm* — Womble Bond Dickinson (US) LLP

(57) ABSTRACT

An adapter for a shaped charge includes a plurality of members configured to be secured to an inner surface of a shaped charge case. Each member of the plurality of members is spaced apart from each other such that the adapter has a central open area. According to an aspect, a securing mechanism is configured to secure the member to an inner surface feature of the shaped charge case.

9 Claims, 22 Drawing Sheets

(56) References Cited

U.S. PATENT DOCUMENTS 2,687,092 A 8/1954 Duesing
2,713,909 A 7/1955 Baker
RE24,127 E 3/1956 Binns et al.
2,755,863 A 7/1956 Stansbury et al.
2,756,958 A 7/1956 Binns et al.
2,799,343 A 7/1957 Conrad
2,821,136 A 1/1958 Castel
2,889,775 A 6/1959 Owen
3,013,491 A 12/1961 Poulter
3,077,834 A 2/1963 Caldwell
3,116,690 A 1/1964 Gillingham et al.
3,158,680 A 11/1964 Lovitt et al.
3,170,400 A 2/1965 Nelson
3,173,992 A 3/1965 Boop
3,208,378 A 9/1965 Boop
3,235,005 A 2/1966 Jacques
3,246,707 A 4/1966 Bell
3,251,300 A 5/1966 Maurice
3,303,884 A 2/1967 Medford
3,357,355 A 12/1967 Roush
3,374,735 A 3/1968 Moore
3,444,810 A 5/1969 Hakala
3,504,723 A 4/1970 Cushman et al.
3,565,188 A 2/1971 Hakala
3,589,453 A 6/1971 Venghiattis
3,859,921 A 1/1975 Stephenson
3,892,455 A 7/1975 Sotolongo
4,007,790 A 2/1977 Henning
4,007,796 A 2/1977 Boop
4,039,239 A 8/1977 Cobaugh et al.
4,058,061 A 11/1977 Mansur, Jr. et al.
4,063,512 A 12/1977 Davis
4,100,978 A 7/1978 Boop
4,107,453 A 8/1978 Erixon
4,109,576 A 8/1978 Eckels
4,182,216 A 1/1980 DeCaro
4,191,265 A 3/1980 Bosse-Platiere
4,234,768 A 11/1980 Boop
4,266,613 A 5/1981 Boop
4,273,047 A 6/1981 Rommer
4,312,273 A 1/1982 Camp
4,346,954 A 8/1982 Appling
4,363,529 A 12/1982 Loose
4,411,491 A 10/1983 Larkin et al.
4,457,383 A 7/1984 Boop
4,479,556 A 10/1984 Stout et al.
4,491,185 A 1/1985 McClure
4,496,008 A 1/1985 Pottier et al.
4,499,830 A 2/1985 Majerus et al.
4,519,313 A 5/1985 Leidel
4,523,650 A 6/1985 Sehnert et al.
4,534,423 A 8/1985 Regalbuto
4,537,132 A 8/1985 Sabranski et al.
4,574,892 A 3/1986 Grigar et al.
4,598,775 A 7/1986 Vann et al.
4,609,057 A 9/1986 Walker et al.
4,619,333 A 10/1986 George
4,621,396 A 11/1986 Walker et al.
4,635,734 A 1/1987 Donovan et al.
4,640,370 A 2/1987 Wetzel
4,650,009 A 3/1987 McClure et al.
4,660,910 A 4/1987 Sharp et al.
4,672,896 A 6/1987 Precoul et al.
4,702,171 A 10/1987 Tal et al.
4,730,793 A 3/1988 Thurber, Jr. et al.
4,739,839 A 4/1988 Regalbuto et al.
4,747,201 A 5/1988 Donovan et al.
4,776,393 A 10/1988 Forehand et al.
4,784,061 A 11/1988 Christopher
4,790,383 A 12/1988 Savage et al.
4,800,815 A 1/1989 Appledorn et al.
4,817,531 A 4/1989 Walker et al.
4,832,134 A 5/1989 Gill
4,852,494 A 8/1989 Williams
4,859,196 A 8/1989 Durando et al.
1,862,804 A 9/1989 Chawla et al.
4,881,445 A 11/1989 Hayes
4,885,993 A 12/1989 Hancock et al.
4,889,183 A 12/1989 Sommers et al.
5,006,833 A 4/1991 Marlowe et al.
5,007,486 A 4/1991 Ricles
5,027,708 A 7/1991 Gonzalez et al.
5,040,619 A 8/1991 Jordan et al.
5,052,489 A 10/1991 Carisella et al.
5,060,573 A 10/1991 Montgomery et al.
5,083,929 A 1/1992 Dalton
5,088,413 A 2/1992 Huber
5,088,557 A 2/1992 Ricles et al.
5,105,742 A 4/1992 Sumner
5,155,293 A 10/1992 Barton
5,159,145 A 10/1992 Carisella et al.
5,223,665 A 6/1993 Burleson et al.
5,237,136 A 8/1993 Langston
5,248,055 A 9/1993 Sanai et al.
5,322,019 A 6/1994 Hyland
5,347,929 A 9/1994 Lerche et al.
5,351,622 A * 10/1994 Ekholm ..... F42B 1/036 102/306
5,358,418 A 10/1994 Carmichael
5,379,845 A 1/1995 Blount et al.
5,392,851 A 2/1995 Arend
5,392,860 A 2/1995 Ross
5,436,791 A 7/1995 Turano et al.
5,501,606 A 3/1996 Oda et al.
5,505,135 A 4/1996 Fritz et al.
5,529,509 A 6/1996 Hayes et al.
5,558,531 A 9/1996 Ikeda et al.
5,565,644 A 10/1996 Chawla
5,567,906 A 10/1996 Reese et al.
5,603,384 A 2/1997 Bethel et al.
5,648,635 A 7/1997 Lussier et al.
5,671,899 A 9/1997 Nicholas et al.
5,673,760 A 10/1997 Brooks et al.
5,679,032 A 10/1997 Auclair
5,703,319 A 12/1997 Fritz et al.
5,753,850 A 5/1998 Chawla et al.
5,759,056 A 6/1998 Costello et al.
5,765,962 A 6/1998 Cornell et al.
5,769,661 A 6/1998 Nealis
5,775,426 A 7/1998 Snider et al.
5,785,130 A 7/1998 Wesson et al.
5,792,977 A 8/1998 Chawla
5,792,980 A 8/1998 Weimann
5,797,761 A 8/1998 Ring
5,816,343 A 10/1998 Markel et al.
5,820,402 A 10/1998 Chiacchio et al.
5,837,925 A 11/1998 Nice
5,871,052 A 2/1999 Benson et al.
5,911,277 A 6/1999 Hromas et al.
5,927,402 A 7/1999 Benson et al.
5,992,289 A 11/1999 George et al.
6,006,833 A 12/1999 Burleson et al.
6,012,525 A 1/2000 Burleson et al.
6,014,933 A 1/2000 Umphries et al.
6,056,058 A 5/2000 Gonzalez
6,085,659 A 7/2000 Beukes et al.
6,098,707 A 8/2000 Pastusek et al.
6,102,724 A 8/2000 Ring
6,112,666 A 9/2000 Murray et al.
6,148,263 A 11/2000 Brooks et al.
6,173,651 B1 1/2001 Pathe et al.
6,182,765 B1 2/2001 Kilgore
6,216,596 B1 4/2001 Wesson
6,269,875 B1 8/2001 Harrison, III et al.
6,283,214 B1 9/2001 Guinot et al.
6,297,447 B1 10/2001 Burnett et al.
6,298,915 B1 10/2001 George
6,305,287 B1 10/2001 Capers et al.
6,315,461 B1 11/2001 Cairns
6,333,699 B1 12/2001 Zierolf
6,349,649 B1 2/2002 Jacoby et al.
6,354,374 B1 3/2002 Edwards et al.
6,378,438 B1 4/2002 Lussier et al.
6,397,947 B1 6/2002 Behrmann et al.

(56) References Cited

U.S. PATENT DOCUMENTS

| | | | |
|---|---|---|---|
| 6,401,818 | B1 | 6/2002 | Papanastasiou |
| 6,408,758 | B1 | 6/2002 | Duguet |
| 6,412,388 | B1 | 7/2002 | Frazier |
| 6,412,415 | B1 | 7/2002 | Kothari et al. |
| 6,413,117 | B1 | 7/2002 | Annerino et al. |
| 6,418,853 | B1 | 7/2002 | Duguet et al. |
| 6,419,044 | B1 | 7/2002 | Tite et al. |
| 6,439,121 | B1 | 8/2002 | Gillingham |
| 6,453,817 | B1 | 9/2002 | Markel et al. |
| 6,454,011 | B1 | 9/2002 | Schempf et al. |
| 6,457,526 | B1 | 10/2002 | Dailey |
| 6,474,931 | B1 | 11/2002 | Austin et al. |
| 6,487,973 | B1 | 12/2002 | Gilbert, Jr. et al. |
| 6,488,093 | B2 | 12/2002 | Moss |
| 6,497,285 | B2 | 12/2002 | Walker |
| 6,510,796 | B2 | 1/2003 | Mayseless et al. |
| 6,619,176 | B2 | 9/2003 | Renfro et al. |
| 6,651,747 | B2 | 11/2003 | Chen et al. |
| 6,659,180 | B2 | 12/2003 | Moss |
| 6,668,726 | B2 | 12/2003 | Lussier |
| 6,739,265 | B1 | 5/2004 | Badger et al. |
| 6,742,602 | B2 | 6/2004 | Trotechaud |
| 6,752,083 | B1 | 6/2004 | Lerche et al. |
| 6,772,868 | B2 | 8/2004 | Warner |
| 6,779,605 | B2 | 8/2004 | Jackson |
| 6,808,021 | B2 | 10/2004 | Zimmerman et al. |
| 6,820,693 | B2 | 11/2004 | Hales et al. |
| 6,843,317 | B2 | 1/2005 | Mackenzie |
| 6,902,414 | B2 | 6/2005 | Dopf et al. |
| 6,925,924 | B2 | 8/2005 | Baker et al. |
| 6,976,857 | B1 | 12/2005 | Shukla et al. |
| 7,011,027 | B2 | 3/2006 | Reese et al. |
| 7,018,164 | B2 | 3/2006 | Anthis et al. |
| 7,036,598 | B2 | 5/2006 | Skjærseth et al. |
| 7,044,219 | B2 | 5/2006 | Mason et al. |
| 7,044,225 | B2 | 5/2006 | Haney et al. |
| 7,044,230 | B2 | 5/2006 | Starr et al. |
| 7,066,261 | B2 | 6/2006 | Vicente et al. |
| 7,074,064 | B2 | 7/2006 | Wallace |
| 7,093,664 | B2 | 8/2006 | Todd et al. |
| 7,107,908 | B2 | 9/2006 | Forman et al. |
| 7,140,453 | B2 | 11/2006 | Ayling |
| 7,168,494 | B2 | 1/2007 | Starr et al. |
| 7,182,611 | B2 | 2/2007 | Borden et al. |
| 7,182,625 | B2 | 2/2007 | Machado et al. |
| 7,193,156 | B2 | 3/2007 | Alznauer et al. |
| 7,193,527 | B2 | 3/2007 | Hall |
| 7,217,917 | B1 | 5/2007 | Tumlin et al. |
| 7,234,525 | B2 | 6/2007 | Alves et al. |
| 7,237,486 | B2 | 7/2007 | Myers, Jr. et al. |
| 7,237,626 | B2 | 7/2007 | Gurjar et al. |
| 7,240,742 | B2 | 7/2007 | Sewell et al. |
| 7,299,903 | B2 | 11/2007 | Rockwell et al. |
| 7,303,017 | B2 | 12/2007 | Barker et al. |
| 7,322,416 | B2 | 1/2008 | Burris, II et al. |
| 7,331,394 | B2 | 2/2008 | Edwards et al. |
| 7,347,278 | B2 | 3/2008 | Lerche et al. |
| 7,347,279 | B2 | 3/2008 | Li et al. |
| 7,353,879 | B2 | 4/2008 | Todd et al. |
| 7,357,083 | B2 | 4/2008 | Takahara et al. |
| 7,364,451 | B2 | 4/2008 | Ring et al. |
| 7,387,162 | B2 | 6/2008 | Mooney, Jr. et al. |
| 7,404,725 | B2 | 7/2008 | Hall et al. |
| 7,405,358 | B2 | 7/2008 | Emerson |
| 7,441,601 | B2 | 10/2008 | George et al. |
| 7,461,580 | B2 | 12/2008 | Bell et al. |
| 7,481,662 | B1 | 1/2009 | Rehrig |
| 7,510,017 | B2 | 3/2009 | Howell et al. |
| 7,540,758 | B2 | 6/2009 | Ho |
| 7,553,078 | B2 | 6/2009 | Hanzawa et al. |
| 7,568,429 | B2 | 8/2009 | Hummel et al. |
| 7,588,080 | B2 | 9/2009 | McCoy |
| 7,631,704 | B2 | 12/2009 | Hagemeyer et al. |
| 7,658,148 | B2 | 2/2010 | Langan et al. |
| 7,661,474 | B2 | 2/2010 | Campbell et al. |
| 7,690,306 | B1 | 4/2010 | King |
| 7,712,416 | B2 | 5/2010 | Pratt et al. |
| 7,726,396 | B2 | 6/2010 | Briquet et al. |
| 7,735,578 | B2 | 6/2010 | Loehr et al. |
| 7,748,447 | B2 | 7/2010 | Moore |
| 7,752,971 | B2 | 7/2010 | Loehr |
| 7,762,172 | B2 | 7/2010 | Li et al. |
| 7,762,331 | B2 | 7/2010 | Goodman et al. |
| 7,762,351 | B2 | 7/2010 | Vidal |
| 7,775,279 | B2 | 8/2010 | Marya et al. |
| 7,778,006 | B2 | 8/2010 | Stewart et al. |
| 7,789,153 | B2 | 9/2010 | Prinz et al. |
| 7,810,430 | B2 | 10/2010 | Chan et al. |
| 7,819,064 | B2 | 10/2010 | Saenger et al. |
| 7,823,508 | B2 | 11/2010 | Anderson et al. |
| 7,886,842 | B2 | 2/2011 | Howard et al. |
| 7,901,247 | B2 | 3/2011 | Ring |
| 7,908,970 | B1 | 3/2011 | Jakaboski et al. |
| 7,929,270 | B2 | 4/2011 | Hummel et al. |
| 7,952,035 | B2 | 5/2011 | Falk et al. |
| 7,980,874 | B2 | 7/2011 | Finke et al. |
| 7,987,911 | B2 | 8/2011 | Rhodes et al. |
| 8,006,765 | B2 | 8/2011 | Richards et al. |
| 8,028,624 | B2 | 10/2011 | Mattson |
| 8,052,490 | B2 | 11/2011 | Bernasch et al. |
| 8,056,632 | B2 | 11/2011 | Goodman |
| 8,066,083 | B2 | 11/2011 | Hales et al. |
| 8,069,789 | B2 | 12/2011 | Hummel et al. |
| 8,079,296 | B2 | 12/2011 | Barton et al. |
| 8,091,477 | B2 | 1/2012 | Brooks et al. |
| 8,127,846 | B2 | 3/2012 | Hill et al. |
| 8,136,585 | B2 | 3/2012 | Cherewyk |
| 8,141,434 | B2 | 3/2012 | Kippersund et al. |
| 8,151,882 | B2 | 4/2012 | Grigar et al. |
| 8,156,871 | B2 | 4/2012 | Behrmann et al. |
| 8,157,022 | B2 | 4/2012 | Bertoja et al. |
| 8,167,044 | B2 | 5/2012 | Huang et al. |
| 8,182,212 | B2 | 5/2012 | Parcell |
| 8,220,394 | B2 | 7/2012 | Bates et al. |
| 8,240,251 | B2 | 8/2012 | Waddell et al. |
| 8,256,337 | B2 | 9/2012 | Hill et al. |
| 8,297,345 | B2 | 10/2012 | Emerson |
| 8,317,448 | B2 | 11/2012 | Hankins et al. |
| 8,322,284 | B2 | 12/2012 | Meddes et al. |
| 8,327,746 | B2 | 12/2012 | Behrmann et al. |
| 8,342,094 | B2 | 1/2013 | Marya et al. |
| 8,395,878 | B2 | 3/2013 | Stewart et al. |
| 8,413,727 | B2 | 4/2013 | Holmes |
| 8,418,622 | B1 | 4/2013 | Pham et al. |
| 8,449,308 | B2 | 5/2013 | Smith |
| 8,469,087 | B2 | 6/2013 | Gray |
| 8,505,454 | B2 | 8/2013 | Boyer et al. |
| 8,505,632 | B2 | 8/2013 | Guerrero et al. |
| 8,544,563 | B2 | 10/2013 | Bourne et al. |
| 8,584,772 | B2 | 11/2013 | Yang et al. |
| 8,596,378 | B2 | 12/2013 | Mason et al. |
| 8,661,978 | B2 | 3/2014 | Backhus et al. |
| 8,701,767 | B2 | 4/2014 | Andrzejak et al. |
| 8,726,996 | B2 | 5/2014 | Busaidy et al. |
| 8,794,153 | B2 | 8/2014 | Glenn |
| 8,807,003 | B2 | 8/2014 | Le et al. |
| 8,863,665 | B2 | 10/2014 | DeVries et al. |
| 8,875,787 | B2 | 11/2014 | Tassaroli |
| 8,881,816 | B2 | 11/2014 | Glenn et al. |
| 8,881,836 | B2 | 11/2014 | Ingram |
| 8,899,322 | B2 | 12/2014 | Cresswell et al. |
| 8,904,935 | B1 | 12/2014 | Brown et al. |
| 8,910,718 | B2 | 12/2014 | Watson et al. |
| 8,931,569 | B2 | 1/2015 | Fagley et al. |
| 8,960,093 | B2 | 2/2015 | Preiss et al. |
| 8,981,957 | B2 | 3/2015 | Gano et al. |
| 8,985,023 | B2 | 3/2015 | Mason |
| 8,997,852 | B1 | 4/2015 | Lee et al. |
| 9,062,539 | B2 | 6/2015 | Schmidt et al. |
| 9,065,191 | B2 | 6/2015 | Martin et al. |
| 9,065,201 | B2 | 6/2015 | Borgfeld et al. |
| 9,080,432 | B2 | 7/2015 | Yang et al. |
| 9,133,695 | B2 | 9/2015 | Xu |
| 9,145,748 | B1 | 9/2015 | Meier et al. |

(56) References Cited

U.S. PATENT DOCUMENTS 9,157,718 B2 10/2015 Ross
9,175,553 B2 11/2015 McCann et al.
9,181,790 B2 11/2015 Mace et al.
9,187,990 B2 11/2015 Xu
9,194,219 B1 11/2015 Hardesty et al.
9,206,675 B2 12/2015 Hales et al.
9,270,051 B1 2/2016 Christiansen et al.
9,284,819 B2 3/2016 Tolman et al.
9,284,824 B2 3/2016 Fadul et al.
9,291,039 B2 3/2016 King et al.
9,291,435 B2 3/2016 Scheid et al.
9,317,038 B2 4/2016 Ozick et al.
9,328,577 B2 5/2016 Hallundbaek et al.
9,359,863 B2 6/2016 Streich et al.
9,360,222 B1 6/2016 Collier
9,382,783 B2 7/2016 Langford et al.
9,383,237 B2 7/2016 Wiklund et al.
9,428,979 B2 8/2016 Bell et al.
9,441,465 B2 9/2016 Tassaroli
9,441,470 B2 9/2016 Guerrero et al.
9,466,916 B2 10/2016 Li et al.
9,476,289 B2 10/2016 Wells
9,484,646 B2 11/2016 Thomas
9,518,443 B2 12/2016 Tunget et al.
9,518,454 B2 12/2016 Current et al.
9,523,255 B2 12/2016 Andrzejak
9,570,897 B2 2/2017 Dobrinski et al.
9,574,416 B2 2/2017 Wright et al.
9,581,422 B2 2/2017 Preiss et al.
9,587,439 B2 3/2017 Lamik-Thonhauser et al.
9,593,548 B2 3/2017 Hill et al.
9,598,942 B2 3/2017 Wells et al.
9,605,937 B2 3/2017 Eitschberger et al.
9,612,093 B2 4/2017 Collier et al.
9,612,095 B2 4/2017 Smart et al.
9,617,194 B2 4/2017 Glenn
9,617,829 B2 4/2017 Dale et al.
9,634,427 B2 4/2017 Lerner et al.
9,651,263 B2 5/2017 Collier
9,671,201 B2 6/2017 Marya et al.
9,683,821 B2 6/2017 Stecher et al.
9,702,669 B1 7/2017 Powell
9,725,993 B1 8/2017 Yang et al.
9,735,405 B1 8/2017 Petkus et al.
9,752,385 B2 9/2017 Hay et al.
9,784,549 B2 10/2017 Eitschberger
9,790,763 B2 10/2017 Fripp et al.
9,797,238 B2 10/2017 Frosell et al.
9,822,618 B2 11/2017 Eitschberger
9,835,015 B2 12/2017 Hardesty
9,845,666 B2 12/2017 Hardesty et al.
9,862,027 B1 1/2018 Loehken
9,874,083 B2 1/2018 Logan et al.
9,903,192 B2 2/2018 Entchev et al.
9,926,750 B2 3/2018 Ringgenberg
9,926,755 B2 3/2018 Van Petegem et al.
10,000,994 B1 6/2018 Sites
10,047,591 B2 8/2018 Bell et al.
10,047,592 B2 8/2018 Burgos et al.
10,054,414 B2 8/2018 Scheid et al.
10,066,921 B2 9/2018 Eitschberger
10,077,641 B2 9/2018 Rogman et al.
10,138,713 B2 11/2018 Tolman et al.
10,151,152 B2 12/2018 Wight et al.
10,151,180 B2 12/2018 Robey et al.
10,151,181 B2 12/2018 Lopez et al.
10,190,398 B2 1/2019 Goodman et al.
10,227,851 B2 3/2019 Collins et al.
10,246,952 B2 4/2019 Trydal et al.
10,309,199 B2 6/2019 Eitschberger
10,321,594 B2 6/2019 Zhu et al.
10,323,484 B2 6/2019 Liess
10,337,270 B2 7/2019 Carisella et al.
10,337,310 B2 7/2019 Bell et al.
10,352,136 B2 7/2019 Goyeneche
10,358,880 B2 7/2019 Metcalf et al.
10,364,387 B2 7/2019 Collier et al.
10,458,213 B1 10/2019 Eitschberger et al.
10,480,295 B2 11/2019 Walker et al.
10,520,286 B2 * 12/2019 Loehken ..... F42B 1/028
10,533,401 B2 1/2020 Hinton et al.
10,597,987 B2 3/2020 Escudero et al.
10,598,002 B2 3/2020 Sites
10,669,822 B2 6/2020 Eitschberger
10,683,703 B2 6/2020 Faircloth et al.
10,683,735 B1 6/2020 McCarthy et al.
10,739,115 B2 8/2020 Loehken et al.
10,767,430 B2 9/2020 Covalt et al.
10,774,624 B2 9/2020 Yang et al.
10,830,566 B2 11/2020 Maxted et al.
10,858,920 B2 12/2020 Wells
10,954,760 B2 3/2021 Mcnelis et al.
10,982,513 B2 4/2021 Gupta et al.
11,002,118 B2 5/2021 Hinton et al.
11,053,782 B2 7/2021 Loehken et al.
11,078,762 B2 8/2021 Mauldin et al.
11,499,401 B2 11/2022 Eitschberger et al.
11,702,912 B2 * 7/2023 Hinton ..... E21B 43/117
102/307
11,753,909 B2 * 9/2023 Loehken ..... E21B 43/26
102/307
12,104,887 B2 * 10/2024 Johnson ..... F42B 3/08
2001/0052303 A1 12/2001 Mayseless et al.
2002/0017214 A1 2/2002 Jacoby et al.
2002/0020320 A1 2/2002 Lebaudy et al.
2002/0036101 A1 3/2002 Huhdanmaki et al.
2002/0040783 A1 4/2002 Zimmerman et al.
2002/0062991 A1 5/2002 Farrant et al.
2002/0129941 A1 9/2002 Alves et al.
2002/0134552 A1 9/2002 Moss
2002/0185275 A1 12/2002 Yang et al.
2003/0000411 A1 1/2003 Cernocky et al.
2003/0001753 A1 1/2003 Cernocky et al.
2003/0098158 A1 5/2003 George et al.
2003/0183113 A1 10/2003 Barlow et al.
2004/0094305 A1 5/2004 Skjærseth et al.
2004/0141279 A1 7/2004 Amano et al.
2004/0211862 A1 10/2004 Elam
2004/0216632 A1 11/2004 Finsterwald
2004/0216868 A1 11/2004 Owen
2004/0239521 A1 12/2004 Zierolf
2005/0011645 A1 1/2005 Aronstam et al.
2005/0103526 A1 5/2005 Ayling
2005/0115448 A1 6/2005 Pratt et al.
2005/0173118 A1 8/2005 Li et al.
2005/0178282 A1 8/2005 Brooks et al.
2005/0183610 A1 8/2005 Barton et al.
2005/0186823 A1 8/2005 Ring et al.
2005/0194146 A1 9/2005 Barker et al.
2005/0217844 A1 10/2005 Edwards et al.
2005/0218260 A1 10/2005 Corder et al.
2005/0229805 A1 10/2005 Myers, Jr. et al.
2006/0013282 A1 1/2006 Hanzawa et al.
2006/0054326 A1 3/2006 Alves et al.
2006/0075889 A1 4/2006 Walker
2007/0084336 A1 4/2007 Neves
2007/0125540 A1 6/2007 Gerez et al.
2007/0158071 A1 7/2007 Mooney, Jr. et al.
2008/0047456 A1 2/2008 Li et al.
2008/0047716 A1 2/2008 McKee et al.
2008/0073081 A1 3/2008 Frazier et al.
2008/0110612 A1 5/2008 Prinz et al.
2008/0121095 A1 5/2008 Han et al.
2008/0134922 A1 6/2008 Grattan et al.
2008/0149338 A1 6/2008 Goodman et al.
2008/0173204 A1 7/2008 Anderson et al.
2008/0223587 A1 9/2008 Cherewyk
2008/0264639 A1 10/2008 Parrott et al.
2009/0050321 A1 2/2009 Rhodes et al.
2009/0050322 A1 2/2009 Hill et al.
2009/0151588 A1 6/2009 Burleson et al.
2009/0151949 A1 6/2009 Marya et al.
2009/0183916 A1 7/2009 Pratt et al.
2009/0211760 A1 8/2009 Richards et al.

(56) References Cited

U.S. PATENT DOCUMENTS

2009/0255728 A1 10/2009 Spencer et al.
2009/0272519 A1 11/2009 Green et al.
2009/0301723 A1 12/2009 Gray
2009/0308589 A1 12/2009 Bruins et al.
2010/0000789 A1 1/2010 Barton et al.
2010/0011945 A1 1/2010 Loehr
2010/0012774 A1 1/2010 Fanucci et al.
2010/0022125 A1 1/2010 Burris et al.
2010/0089643 A1 4/2010 Vidal
2010/0096131 A1 4/2010 Hill et al.
2010/0107917 A1 5/2010 Moser
2010/0163224 A1 7/2010 Strickland
2010/0230104 A1 9/2010 Nölke et al.
2010/0230163 A1 9/2010 Hales et al.
2010/0252323 A1 10/2010 Goodman et al.
2010/0286800 A1 11/2010 Lerche et al.
2010/0288496 A1 11/2010 Cherewyk
2010/0300750 A1 12/2010 Hales et al.
2011/0005777 A1 1/2011 Meff
2011/0024116 A1 2/2011 McCann et al.
2011/0024117 A1 2/2011 Cardenas et al.
2011/0042069 A1 2/2011 Bailey et al.
2011/0155013 A1 6/2011 Boyer et al.
2011/0209871 A1 9/2011 Le et al.
2011/0301784 A1 12/2011 Oakley et al.
2012/0085538 A1 4/2012 Guerrero et al.
2012/0094553 A1 4/2012 Fujiwara et al.
2012/0152542 A1 6/2012 Le
2012/0160491 A1 6/2012 Goodman et al.
2012/0180678 A1 7/2012 Kneisl
2012/0199031 A1 8/2012 Lanclos
2012/0199352 A1 8/2012 Lanclos et al.
2012/0241169 A1 9/2012 Hales et al.
2012/0242135 A1 9/2012 Thomson et al.
2012/0247769 A1 10/2012 Schacherer et al.
2012/0247771 A1 10/2012 Black et al.
2012/0298361 A1 11/2012 Sampson
2013/0048376 A1 2/2013 Rodgers et al.
2013/0056208 A1 3/2013 Xu
2013/0062055 A1 3/2013 Tolman et al.
2013/0118342 A1 5/2013 Tassaroli
2013/0118805 A1 5/2013 Moody-Stuart et al.
2013/0126237 A1 5/2013 Burton et al.
2013/0153205 A1 6/2013 Borgfeld et al.
2013/0168083 A1 7/2013 McCarter et al.
2013/0199843 A1 8/2013 Ross
2013/0220614 A1 8/2013 Torres et al.
2013/0228326 A1 9/2013 Griffith et al.
2013/0248174 A1 9/2013 Dale et al.
2013/0256464 A1 10/2013 Belik et al.
2013/0327571 A1 12/2013 Andrzejak
2013/0340643 A1 12/2013 Yang et al.
2014/0008071 A1 1/2014 Patterson et al.
2014/0026776 A1 1/2014 Kecskes et al.
2014/0033939 A1 2/2014 Priess et al.
2014/0053750 A1 2/2014 Lownds et al.
2014/0061376 A1 3/2014 Fisher et al.
2014/0083774 A1 3/2014 Hoult et al.
2014/0127941 A1 5/2014 Lu
2014/0131035 A1 5/2014 Entchev et al.
2014/0144702 A1 5/2014 Walker
2014/0148044 A1 5/2014 Balcer et al.
2014/0218207 A1 8/2014 Gano et al.
2014/0251612 A1 9/2014 Powers
2014/0314977 A1 10/2014 Weinhold
2014/0360720 A1 12/2014 Corbeil
2015/0114626 A1 4/2015 Hatten et al.
2015/0136419 A1 5/2015 Mauldin
2015/0167410 A1 6/2015 Garber et al.
2015/0176386 A1 6/2015 Castillo et al.
2015/0209954 A1 7/2015 Hokanson
2015/0275615 A1 10/2015 Rytlewski et al.
2015/0285019 A1 10/2015 Wood et al.
2015/0316360 A1 11/2015 Hinton et al.
2015/0330192 A1 11/2015 Rogman et al.
2015/0354310 A1 12/2015 Zaiser
2015/0361774 A1 12/2015 Flores
2015/0376991 A1 12/2015 Mcnelis et al.
2016/0040502 A1 2/2016 Robben
2016/0040520 A1 2/2016 Tolman et al.
2016/0061572 A1 3/2016 Eitschberger et al.
2016/0069163 A1 3/2016 Tolman et al.
2016/0084048 A1 3/2016 Harrigan et al.
2016/0108722 A1 4/2016 Whitsitt et al.
2016/0115741 A1 4/2016 Davis
2016/0144734 A1 5/2016 Wang et al.
2016/0153267 A1 6/2016 Walker et al.
2016/0168961 A1 6/2016 Parks et al.
2016/0169639 A1 6/2016 Smart et al.
2016/0202027 A1 7/2016 Peterson et al.
2016/0208587 A1 7/2016 Hardesty et al.
2016/0215592 A1 7/2016 Helms et al.
2016/0223171 A1 8/2016 Gibbons et al.
2016/0258240 A1 9/2016 Fripp et al.
2016/0290098 A1 10/2016 Marya
2016/0349021 A1 12/2016 Collier et al.
2016/0356132 A1 12/2016 Burmeister et al.
2017/0030693 A1 2/2017 Preiss et al.
2017/0032653 A1 2/2017 Crawford et al.
2017/0044875 A1 2/2017 Hebebrand et al.
2017/0051586 A1 2/2017 Wells et al.
2017/0052004 A1 2/2017 Xue
2017/0052011 A1 2/2017 Parks et al.
2017/0058648 A1 3/2017 Geerts et al.
2017/0058649 A1 3/2017 Geerts et al.
2017/0067303 A1 3/2017 Thiemann et al.
2017/0067320 A1 3/2017 Zouhair et al.
2017/0074078 A1 3/2017 Eitschberger
2017/0145798 A1 5/2017 Robey et al.
2017/0159379 A1 6/2017 Metcalf et al.
2017/0167233 A1 6/2017 Sampson et al.
2017/0175488 A1 6/2017 Lisowski et al.
2017/0175498 A1 6/2017 Segura
2017/0175500 A1 6/2017 Robey et al.
2017/0199015 A1 7/2017 Collins et al.
2017/0204687 A1 7/2017 Yorga et al.
2017/0211363 A1 7/2017 Bradley et al.
2017/0241244 A1 8/2017 Barker et al.
2017/0268860 A1 9/2017 Fitschberger
2017/0275976 A1 9/2017 Collins et al.
2017/0276465 A1 9/2017 Parks et al.
2017/0306710 A1 10/2017 Trydal et al.
2017/0314372 A1 11/2017 Tolman et al.
2017/0357021 A1 12/2017 Valero et al.
2018/0002999 A1 1/2018 Johnson
2018/0003038 A1 1/2018 Cherewyk
2018/0003045 A1 1/2018 Dotson et al.
2018/0030334 A1 2/2018 Collier et al.
2018/0038208 A1 2/2018 Eitschberger et al.
2018/0087369 A1 3/2018 Sherman et al.
2018/0135398 A1 5/2018 Entchev et al.
2018/0202789 A1 7/2018 Parks et al.
2018/0209250 A1 7/2018 Daly et al.
2018/0209251 A1 7/2018 Robey et al.
2018/0252507 A1 9/2018 Collier
2018/0274342 A1 9/2018 Sites
2018/0291715 A1 10/2018 Barker
2018/0299239 A1 10/2018 Eitschberger et al.
2018/0306010 A1 10/2018 Von Kaenel et al.
2018/0313182 A1 11/2018 Cherewyk et al.
2018/0318770 A1 11/2018 Eitschberger et al.
2018/0340412 A1 11/2018 Singh et al.
2018/0355674 A1 12/2018 Cooper et al.
2019/0031307 A1 1/2019 Siersdorfer
2019/0040722 A1 2/2019 Yang et al.
2019/0048693 A1 2/2019 Henke et al.
2019/0049225 A1 2/2019 Eitschberger
2019/0085664 A1 3/2019 Hardesty et al.
2019/0085685 A1 3/2019 McBride
2019/0113315 A1 4/2019 Dai et al.
2019/0153827 A1 5/2019 Goyeneche
2019/0162056 A1 5/2019 Sansing
2019/0186211 A1 6/2019 Gonzalez
2019/0218880 A1 7/2019 Cannon et al.

(56) References Cited

U.S. PATENT DOCUMENTS

| | | | | |
|---|---|---|---|---|
| 2019/0219375 | A1 | 7/2019 | Parks et al. | |
| 2019/0234188 | A1 | 8/2019 | Goyeneche | |
| 2019/0242222 | A1 | 8/2019 | Eitschberger | |
| 2019/0257181 | A1 | 8/2019 | Langford et al. | |
| 2019/0284889 | A1 | 9/2019 | LaGrange et al. | |
| 2019/0292887 | A1 | 9/2019 | Austin et al. | |
| 2019/0316449 | A1 | 10/2019 | Schultz et al. | |
| 2019/0330961 | A1 | 10/2019 | Knight et al. | |
| 2019/0338606 | A1 | 11/2019 | Metcalf et al. | |
| 2019/0338612 | A1 | 11/2019 | Holodnak et al. | |
| 2019/0353013 | A1 | 11/2019 | Sokolove et al. | |
| 2019/0368301 | A1 | 12/2019 | Eitschberger et al. | |
| 2020/0024934 | A1 | 1/2020 | Eitschberger et al. | |
| 2020/0024935 | A1 | 1/2020 | Eitschberger et al. | |
| 2020/0040714 | A1 | 2/2020 | Surjaatmadja et al. | |
| 2020/0063553 | A1 | 2/2020 | Zemla et al. | |
| 2020/0300067 | A1 | 9/2020 | Mcnelis et al. | |
| 2021/0048284 | A1 | 2/2021 | Maxted et al. | |
| 2021/0164330 | A1 | 6/2021 | Mcnelis et al. | |
| 2021/0238966 | A1 | 8/2021 | Preiss et al. | |
| 2021/0254938 | A1 | 8/2021 | Mcnelis et al. | |
| 2021/0277752 | A1 | 9/2021 | Eitschberger | |
| 2021/0293107 | A1 | 9/2021 | Eitschberger | |
| 2021/0293121 | A1 | 9/2021 | Loehken et al. | |
| 2021/0301599 | A1 | 9/2021 | Mulhern et al. | |
| 2021/0301632 | A1 | 9/2021 | Loehken et al. | |
| 2021/0381348 | A1 | 12/2021 | Wuensche et al. | |
| 2022/0074719 | A1 | 3/2022 | Yang | |
| 2022/0081999 | A1 | 3/2022 | Wesson et al. | |
| 2024/0280350 | A1 * | 8/2024 | Wilson | F42B 1/02 |

FOREIGN PATENT DOCUMENTS

| | | | | |
|---|---|---|---|---|
| CA | 2196385 | A1 | 7/1998 | |
| CA | 2833722 | A1 | 5/2014 | |
| CA | 2821506 | A1 | 1/2015 | |
| CA | 2824838 | A1 | 2/2015 | |
| CA | 2941648 | A1 | 9/2015 | |
| CA | 3021913 | A1 | 2/2018 | |
| CA | 3101558 | A1 | 12/2019 | |
| CA | 2933762 | C | 4/2020 | |
| CN | 85107897 | A | 9/1986 | |
| CN | 1082601 | C | 4/2002 | |
| CN | 2648065 | | 10/2004 | |
| CN | 1199130 | C | 4/2005 | |
| CN | 1965148 | A | 5/2007 | |
| CN | 201184775 | | 1/2009 | |
| CN | 101454635 | A | 6/2009 | |
| CN | 201546707 | U | 8/2010 | |
| CN | 101178005 | B | 10/2010 | |
| CN | 201620848 | U | 11/2010 | |
| CN | 202165062 | U | 3/2012 | |
| CN | 102738639 | A | 10/2012 | |
| CN | 202810806 | U | 3/2013 | |
| CN | 103485750 | A | 1/2014 | |
| CN | 104278976 | A | 1/2015 | |
| CN | 204430910 | U | 7/2015 | |
| CN | 104989335 | A | 10/2015 | |
| CN | 105377479 | A | 3/2016 | |
| CN | 205805521 | U | 12/2016 | |
| CN | 104314529 | B | 1/2017 | |
| CN | 205895214 | U | 1/2017 | |
| CN | 208347755 | U | 1/2019 | |
| CN | 208870580 | U | 5/2019 | |
| CN | 209195374 | U | 8/2019 | |
| CN | 209195375 | U | 8/2019 | |
| CN | 110424930 | A | 11/2019 | |
| CN | 209908471 | U | 1/2020 | |
| CN | 210598934 | U | 5/2020 | |
| CN | 211115936 | U | 7/2020 | |
| CN | 111971453 | A | 11/2020 | |
| CN | 213297926 | U | 5/2021 | |
| DE | 3933955 | A1 * | 4/1991 | F42B 1/02 |
| DE | 19630339 | A1 | 1/1997 | |
| DE | 10341437 | A1 | 4/2005 | |
| DE | 10344523 | A1 | 4/2005 | |
| DE | 102007007498 | | 10/2015 | |
| EP | 0216527 | B1 | 11/1990 | |
| EP | 0416915 | A2 | 3/1991 | |
| EP | 0180520 | B1 | 5/1991 | |
| EP | 0773425 | B1 | 5/1997 | |
| EP | 0721051 | A3 | 4/1998 | |
| EP | 1345003 | A2 | 9/2003 | |
| EP | 1317650 | B1 | 5/2006 | |
| EP | 2282003 | A2 | 2/2011 | |
| EP | 1682846 | B1 | 1/2014 | |
| EP | 2952675 | A2 | 9/2015 | |
| EP | 2310616 | B1 | 10/2017 | |
| EP | 3277913 | A1 | 2/2018 | |
| EP | 3239648 | B1 | 9/2018 | |
| EP | 3568664 | A1 | 11/2019 | |
| EP | 3478928 | B1 | 6/2021 | |
| FR | 2756879 | A1 | 6/1998 | |
| GB | 916870 | A | 1/1963 | |
| GB | 2295664 | A | 6/1996 | |
| GB | 2533822 | A | 7/2016 | |
| GB | 2544247 | A | 5/2017 | |
| GB | 2548101 | A | 9/2017 | |
| GB | 2548203 | A | 9/2017 | |
| GB | 2562179 | B | 11/2018 | |
| RU | 2175379 | C2 | 10/2001 | |
| RU | 2295694 | C2 | 3/2007 | |
| RU | 78521 | U1 | 11/2008 | |
| RU | 93521 | U1 | 4/2010 | |
| RU | 100552 | U1 | 12/2010 | |
| RU | 2434122 | C2 | 11/2011 | |
| RU | 2489567 | C1 | 8/2013 | |
| RU | 2542024 | C1 | 2/2015 | |
| RU | 2579307 | C1 | 4/2016 | |
| RU | 2633904 | C1 | 10/2017 | |
| WO | 2001004452 | A1 | 1/2001 | |
| WO | 0133029 | A3 | 5/2001 | |
| WO | 0159401 | A1 | 8/2001 | |
| WO | 2001096807 | A2 | 12/2001 | |
| WO | 2005103602 | A2 | 11/2005 | |
| WO | 2006054081 | A1 | 5/2006 | |
| WO | 2009117548 | A1 | 9/2009 | |
| WO | 2009091422 | A3 | 3/2010 | |
| WO | 2011146866 | A2 | 11/2011 | |
| WO | 2011150251 | A1 | 12/2011 | |
| WO | 2011160099 | A1 | 12/2011 | |
| WO | 2012006357 | A3 | 4/2012 | |
| WO | 2012140102 | A1 | 10/2012 | |
| WO | 2012161854 | A2 | 11/2012 | |
| WO | 2015028204 | A2 | 3/2015 | |
| WO | 2015081092 | A3 | 8/2015 | |
| WO | 2015134719 | A1 | 9/2015 | |
| WO | 2017029240 | A1 | 2/2017 | |
| WO | 2017062444 | A1 | 4/2017 | |
| WO | 2017147329 | A1 | 8/2017 | |
| WO | 2018009223 | A1 | 1/2018 | |
| WO | 2018057949 | A1 | 3/2018 | |
| WO | 2018067598 | A1 | 4/2018 | |
| WO | 2018094220 | A1 | 5/2018 | |
| WO | 2018177733 | A1 | 10/2018 | |
| WO | 2018234013 | A1 | 12/2018 | |
| WO | 2019071027 | A1 | 4/2019 | |
| WO | 2019117861 | A1 | 6/2019 | |
| WO | 2019117874 | A1 | 6/2019 | |
| WO | 2019204137 | A1 | 10/2019 | |
| WO | 2019238410 | A1 | 12/2019 | |
| WO | 2020154061 | A1 | 7/2020 | |
| WO | 2021123041 | A1 | 6/2021 | |

OTHER PUBLICATIONS

United States Patent and Trademark Office; Non-Final Office Action for U.S. Appl. No. 17/336,617; dated Mar. 30, 2023; 7 pages.

United States Patent and Trademark Office; Requirement for Restriction/Election for U.S. Appl. No. 17/336,617; dated Feb. 13, 2023; 7 pages.

Borisenko et al., Hardness of Dispersion-Hardened Copper at Temperatures 290-1070 K, Strength of Materials, vol. 35, No. 4,

(56) References Cited

OTHER PUBLICATIONS 2003, 1 page, https://link.springer.com/article/10.1023/A:1025842425119.
Dynaenergetics, Dynaslot System 360° Certainty Well Abandonment, Produce Brochure, 6 pgs., https://www.dynaenergetics.com/en/products/hardware-and-tcp/perforating-gun-systems/dynaslot-gun-system.
Dynaenergetics, Unfavorable Trade-Off: High Temperature Explosives vs. Performance Sacrifice, dated May 9, 2016, 19 pages, https://www.perforators.org/wp-content/uploads/2016/05/IPS-16-17.pdf.
European Patent Office; International Preliminary Report On Patentability for PCT/EP2019/054442; Oct. 15, 2020; 9 pages.
Fedorov, Thermal softening of metallic shaped-charge jets formed by the collapse of shaped-charge liners in the presence of a magnetic field, May 2016, Journal of Applied Mechanics and Technical Physics, pp. 483-493, 12 pages.
HSM Wire International, Inc, Melting Temperatures of common metals and alloys, dated Jul. 9, 2013, 2 pages.
Hunting Energy Service, ControlFire RF Safe ControlFire® RF-Safe Manual, 33 pgs., Jul. 2016, http://www.hunting-intl.com/media/2667160/ControlFire%20RF_Assembly%20Gun%20Loading_Manual.pdf.
International Search Report and Written Opinion of International App. No. PCT/EP2019/054442, mailed May 21, 2019; 14 pgs.
Jilong, Han, et al., Application of W/Zr amorphous alloy for shaped charge liner, Materials Research Express, Oct. 11, 2019, 13 pages.
Naeem, Khalid et al., A Review of Shaped Charge Variables for its Optimum Performance, Engineering, Technology & Applied Science Research, 2019, 8 pages.
Owen Oil Tools, E & B Select Fire Side Port, Tandem Sub, Apr. 2010, 2 pgs., https://www.corelab.com/owen/cms/docs/Canada/10A_eandbsystem-01.0-c.pdf.
Owen Oil Tools, Expendable Perforating Guns, Jul. 2008, 7 pgs., https://www.corelab.com/owen/cms/docs/Canada/10A_erhsc-01.0-c.pdf.
Pyka et al., Applied Sciences Numerical and Experimental Studies of the ŁK Type Shaped Charge, Aug. 15, 2020, 20 pgs., https://www.researchgate.net/publication/344387825_Numerical_and_Experimental_Studies_of_the_LK_Type_Shaped_Charge.
Schatt et al., Pulvermetallurgie: Technologien und Werkstoffe, Edition: 2, 2006, see Temperature tables on p. 444, 2 pages.
United States Patent and Trademark Office, Non-Final Office Action of U.S. Appl. No. 16/002,217, dated Jun. 27, 2019, 13 pages.
United States Patent and Trademark Office, Restriction Requirement for U.S. Appl. No. 16/258,810, dated Aug. 20, 2020, 8 pgs.
United States Patent and Trademark Office, Restriction Requirement of U.S. Appl. No. 16/002,217, dated Dec. 11, 2018, 6 pages.
United States Patent and Trademark Office; Ex Parte Quayle Action for U.S. Appl. No. 16/258,810; dated Jan. 25, 2021; 8 pages.
United States Patent and Trademark Office; Notice of Allowance for U.S. Appl. No. 16/258,810; dated Mar. 3, 2021; 7 pages.
Vigor, Perforating Gun Accessories, China Vigor Drilling Oil Tools and Equipment Co.,Ltd., Sep. 14, 2018, 4 pgs., http://www.vigordrilling.com/completion-tools/perforating-gun-accessories.html.
Walters et al., Army Research Laboratory, The Particulation of a Shaped Charge Jet for Face-Centered-Cubic Liner Materials, AD-A263297, dated Apr. 1993, 60 pages.

* cited by examiner

ADAPTER AND SHAPED CHARGE APPARATUS FOR OPTIMIZED PERFORATION JET

CROSS-REFERENCE TO RELATED APPLICATIONS

This application claims the benefit of U.S. Provisional Patent Application No. 63/271,464 filed Oct. 25, 2021, the entire contents of which are incorporated herein by reference.

BACKGROUND

Perforating gun assemblies are used in many oilfield and gas well completions. In particular, the assemblies may be used for, among other things, any or all of generating holes in downhole pipe/tubing (such as a steel casing) to gain access to an oil/gas deposit formation and to create flow paths for fluids used to clean and/or seal off a well and perforating the oil/gas deposit formation to liberate the oil/gas from the formation. The perforating gun assemblies are usually cylindrical and include a detonating cord arranged within the interior of the assembly and connected to shaped charges, hollow charges or perforators disposed therein. The detonating cord is used to initiate/detonate the shaped charges. Once the detonating cord is activated by, for example a detonator, a detonation wave travels through a length of the detonating cord to initiate each shaped charge. Once the detonation wave passes by the initiation point of each shaped charge, another detonation wave is created that sweeps through the shaped charge. A liner and/or other materials within the shaped charge are collapsed and propelled out of the shaped charge in a perforating jet of thermal energy and solid material. The shaped charges may be designed such that the physical force, heat, and/or pressure of the perforating jet, expelled materials, and shaped charge explosion will perforate, among other things, steel, concrete, and geological formations.

Shaped charges for perforating guns used in wellbore operations come in many shapes/geometries. For example, shaped charges typically include a case that is dimensioned to receive liners of various shapes (such as, hemispherical, conical, frustoconical, or rectangular). The shape of the shaped charge and the corresponding liner housed therein, determines the geometry of the perforating jet and/or perforation (hole) that is produced by the charge upon detonation. Hemispherical, conical, and frustoconical shaped charge liners (typically housed in conical shaped charges or rotational symmetric shaped charges) tend to produce round/(semi-) circular perforations, while rectangular, or "slotted", shaped charges tend to produce rectangular and/or linear perforations ("slots"). Particular geometries may be useful for specific applications in wellbore operations. For example, conical charges may produce a concentrated perforating jet that penetrates deep into a geological formation, to enhance access to oil/gas formations. On the other hand, slotted shaped charges may be useful in forming overlapping rectangular slots to allow full 360-degree access through a wellbore casing to flow concrete and seal a wellbore upon abandonment.

Upon detonation of the shaped charge, a perforation jet forms a perforation hole in a target. The geometry of the perforation (hole) that is produced by the shaped charge depends, at least in part, on the shape of the shaped charge case. Shaped charges with round/circular cases tend to produce round/circular perforations. An example of a conical shaped charge 10 is illustrated in FIG. 1A and FIG. 1B. As illustrated in FIG. 1A, the shaped charge 10 includes a case 20 (i.e., a conical case), an explosive load 30 housed in the case and a liner 40 disposed over the explosive load 30. A cross-sectional view of the shaped charge 10 (shown in FIG. 1B) illustrates that the shaped charge has a circular cross-section, which produces round perforations 50 (FIG. 1C) in a target. Shaped charges with rectangular or "slotted" cases tend to produce rectangular and/or linear perforations. The linear perforations can overlap each other in a helical pattern, and thereby perforate a cylindrical target around all 360° of the target. Such a pattern may be useful during abandonment of a well, where concrete is pumped into the well and must reach and seal substantially all areas of the wellbore.

One disadvantage of existing shaped charges is that the geometry of the shaped charge and associated perforating jet is set when the shaped charge is manufactured according to corresponding specifications. As such, during manufacture of shaped charges, multiple shaped charge cases must be manufactured when conical and slotted shaped charges are both desired. The particularized use of different shaped charge cases thereby increases the costs and efforts associated with, e.g., manufacturing smaller batches of shaped charges, holding inventory of specific shaped charge cases.

Based at least on the above considerations, devices, systems, and methods for changing the types of perforation geometry of a shaped charge case can help to facilitate would provide economic and logistical benefits. For example, a standard conical shaped charge case may be adapted with a device during assembly of the shaped charge and its components to produce a variety of perforation geometries, thus saving on manufacturing costs for customizing shaped charges and obviating the need to keep a variety of shaped charge cases at a wellbore location.

BRIEF SUMMARY

Embodiments of the disclosure are associated with an adapter configured for use with a shaped charge. The adapter includes a plurality of members configured to be secured to an inner surface of a shaped charge case. A securing mechanism may also be provided to secure the member to an inner surface feature of the shaped charge case. According to an aspect, each member of the plurality of members is spaced apart from each other such that the adapter has a central open area.

Embodiments of the disclosure may be associated with an adapter for a shaped charge. The adapter includes a collar; and a plurality of members secured to the collar in a spaced apart configuration from each other such that the adapter has a central open area. According to an aspect, the collar and the plurality of members are secured to an inner surface of a shaped charge case.

Further embodiments of the disclosure are associated with a shaped charge. The shaped charge includes a shaped charge case having an inner surface and an outer surface. According to an aspect, the inner surface defines a hollow interior of the shaped charge case. An adapter is positioned in or otherwise coupled to the inner surface of the shaped charge case. According to an aspect, the adapter includes a plurality of members secured to the inner surface in a spaced apart configuration from each other, such that the adapter has a central open area. The shaped charge includes an explosive load that is disposed within the hollow interior atop the adapter, such that the explosive load covers the adapter and is in direct contact with a portion of the inner surface of the shaped charge case. According to an aspect, a liner is disposed adjacent the explosive load. At least a portion of the adapter displaces some of the explosive load such that the adapter is configured to produce an atypical geometry perforating jet upon detonation of the shaped charge.

BRIEF DESCRIPTION OF THE SEVERAL VIEWS OF THE DRAWINGS

A more particular description will be rendered by reference to specific embodiments thereof that are illustrated in the appended drawings. Understanding that these drawings depict only typical embodiments thereof and are not therefore to be considered to be limiting of its scope, exemplary embodiments will be described and explained with additional specificity and detail through the use of the accompanying drawings in which.

DETAILED DESCRIPTION

Reference will now be made in detail to various embodiments. Each example is provided by way of explanation and is not meant as a limitation and does not constitute a definition of all possible embodiments.

For purposes of this disclosure, the phrases "apparatus", "device(s)", "system(s)", and "method(s)" may be used either individually or in any combination referring without limitation to disclosed components, grouping, arrangements, steps, functions, or processes.

The exemplary embodiments relate generally to a shaped charge and an adapter/insert coupled to an inner surface of a shaped charge case to change a particular geometry of a perforating jet and/or perforation produced by the shaped charge. According to an aspect, the adapter is secured or otherwise coupled to the inner surface a conical shaped charge case so that detonation of the shaped charge causes a rectangularly-shaped perforation and/or linear slot and/or elliptical shaped perforation to be formed in a target, rather than a traditional round/circular perforation. The adapters described herein change the inner geometry of the shaped charge case to create different explosive forces across the liner, which results in slot shaped perforation holes.

For purposes of illustrating features of the embodiments, various embodiments are introduced and referenced throughout the disclosure. These embodiments are illustrative and not limiting, and examples are provided purely for explanatory purposes.

Figure 1A:
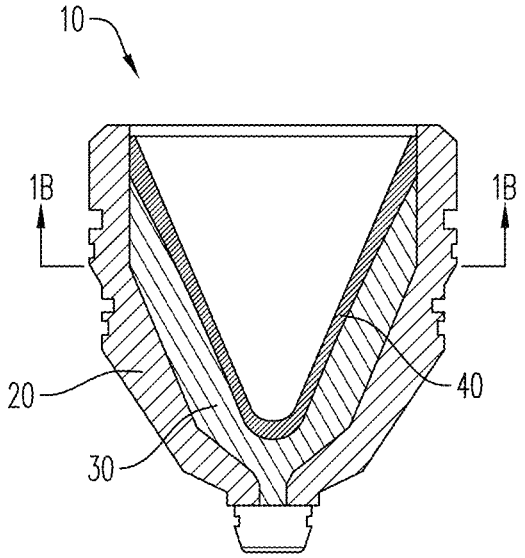
FIG. 1A is a cross-sectional view of standard conical shaped charge, according to the prior art.

FIG. 1A is a cross-sectional view of standard conical shaped charge, according to the prior art. Such a standard conical shaped charge may include additional features as those described according to the present disclosure to create an alternate perforation hole geometry.

Figure 1B:
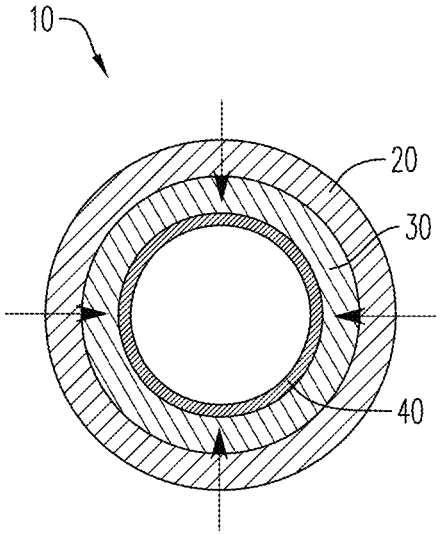
FIG. 1B is a cutaway view of the shaped charge of FIG. 1A, taken along lines 1B-1B.

FIG. 1B is a cutaway view of the shaped charge of FIG. 1A, taken along lines 1B-1B.

Figure 1C:
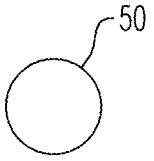
FIG. 1C is a perforation hole geometry created upon detonation of the shaped charge of FIG. 1A.

FIG. 1C is a perforation hole geometry created upon detonation of the shaped charge of FIG. 1A. As illustrated, the perforation created by the conical shaped charge has a circular/round shape.

Figure 2A:
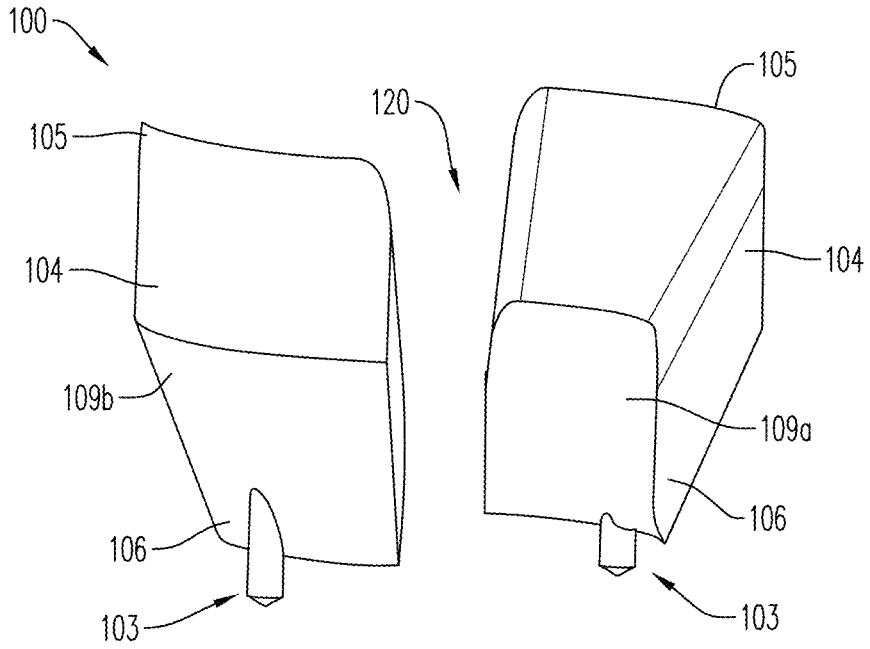
FIG. 2A is a perspective view of an adapter including a plurality of members having a securing mechanism, according to an embodiment.
Figure 3A:
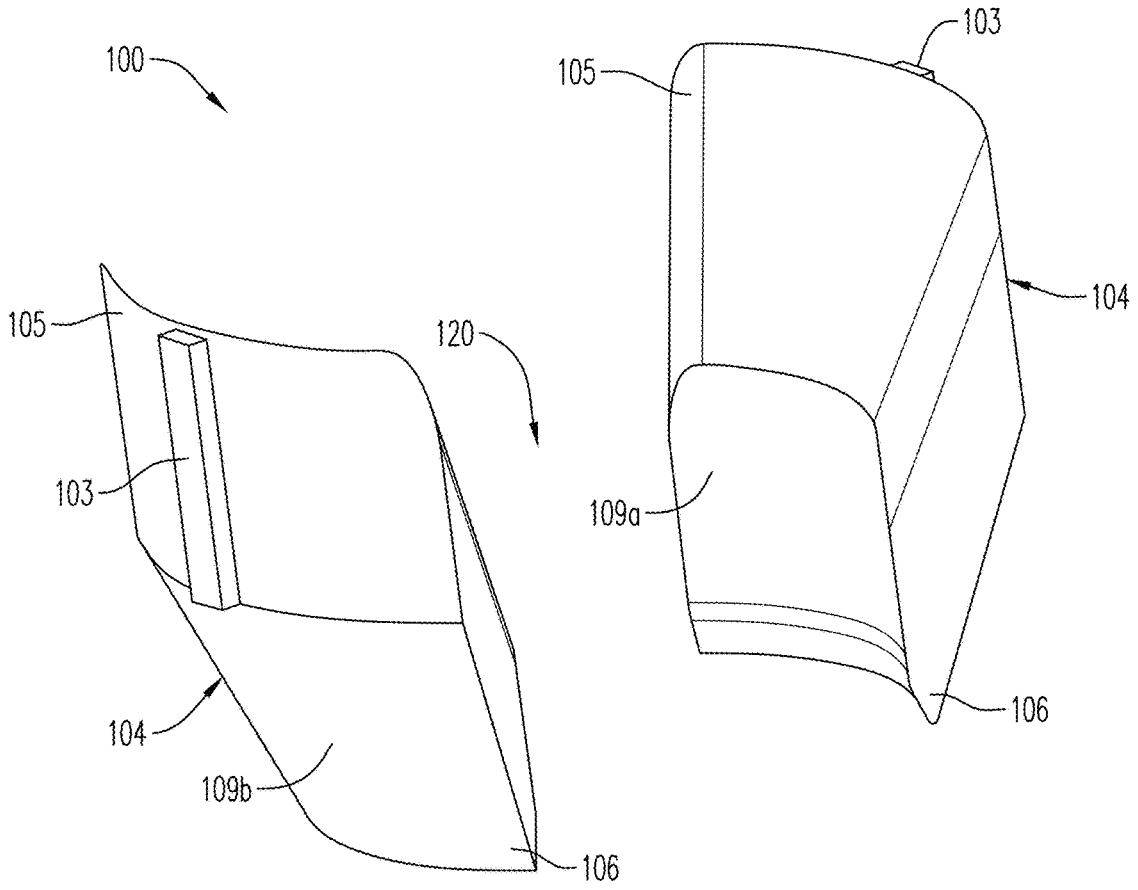
FIG. 3A is a perspective view of an adapter including a plurality of members having a securing mechanism, according to an embodiment.

FIG. 2A and FIG. 3A illustrate an adapter/insert/internal inlay 100 configured for use with a shaped charge assembly/shaped charge 200. The adapter 100 includes a plurality of members 104 configured to be secured to an inner surface 204 of a shaped charge case 201. The members 104 are formed from an inert material that does not react with other materials/components of a shaped charge. According to an aspect, the entire adapter 100 is formed from an inert material. The adapter 100 may be 3D printed, injection molded or machined. The adapter 100 may be formed from a polymer. The adapter 100 may have a density range of about 1.05 g/cm3 to about 2.5 g/cm3. According to an aspect, the members 104 include a rigid or semi-rigid material that includes at least one of a plastic material or rubber material, a polymer, a metal, and the like. According to an aspect, the members 104 comprise wood. The members 104 may be composed of any compressible material that can be adopted to the shape of the members 104. For example, the members 104 may include a salt-based material, with or without a binder.

The members 104 each have a first surface 109*a* and a second surface 109*b*. The members 104 may have a uniform thickness T1 (FIG. 3B and FIG. 3C) between the first and second surfaces 109*a*, 109*b*. As illustrated in FIG. 2C and FIG. 3E, for example, the adapter 100 may be configured to be positioned and secured in the shaped charge case 201, such that the second surface 109*b* of each member 104 is adjacent the inner surface 204 of the shaped charge case 201. While the members 104 are illustrated having a substantially rectangular shape, it is contemplated that the members may have any desired shape. For example, it is contemplated that the members 104 may have a generally isosceles trapezoid shape. As described throughout this disclosure, varying geometries of an adapter may produce varying geometries of perforations.

According to an aspect, each member 104 is spaced apart from each other such that the adapter 100 has a central open area 120. The adapter 100 illustrated in FIGS. 2A and 2C, refers collectively to the two members 104 and the central open area 120 refers to the space between the two members 104. When the adapter 100 is positioned in a shaped charge case 201, the central open area 120 is above an initiation point 205 formed in the back wall 215 of the shaped charge case 201. This particular arrangement of the members 104 displaces an explosive load that is housed in the shaped charge case 201 and creates an atypical shape or geometry of a perforating jet and/or perforation produced upon detonation of the shaped charge 200, as described throughout this disclosure.

One or more securing mechanisms 103 may extend from or be otherwise secured to the member 104 and are configured to secure the member 104 to an internal surface (i.e., an internal surface feature 207) of the shaped charge case 201. As used herein, securing mechanisms 103 may include any material that maintains the members 104 in place by friction fit. Securing mechanisms 103 may include clamps, adhesives, clips, welding, or other known techniques. Various configurations of internal surface features 207 are illustrated in FIGS. 2B and 3D.

Figure 2B:
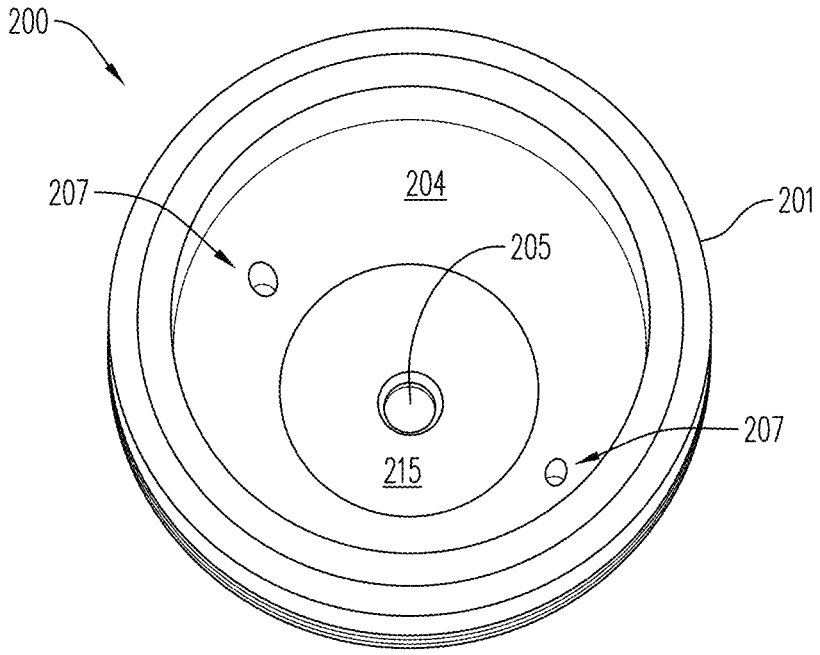
FIG. 2B is a top down, perspective view of a shaped charge configured for receiving and securing the adapter of FIG. 2A.
Figure 2C:
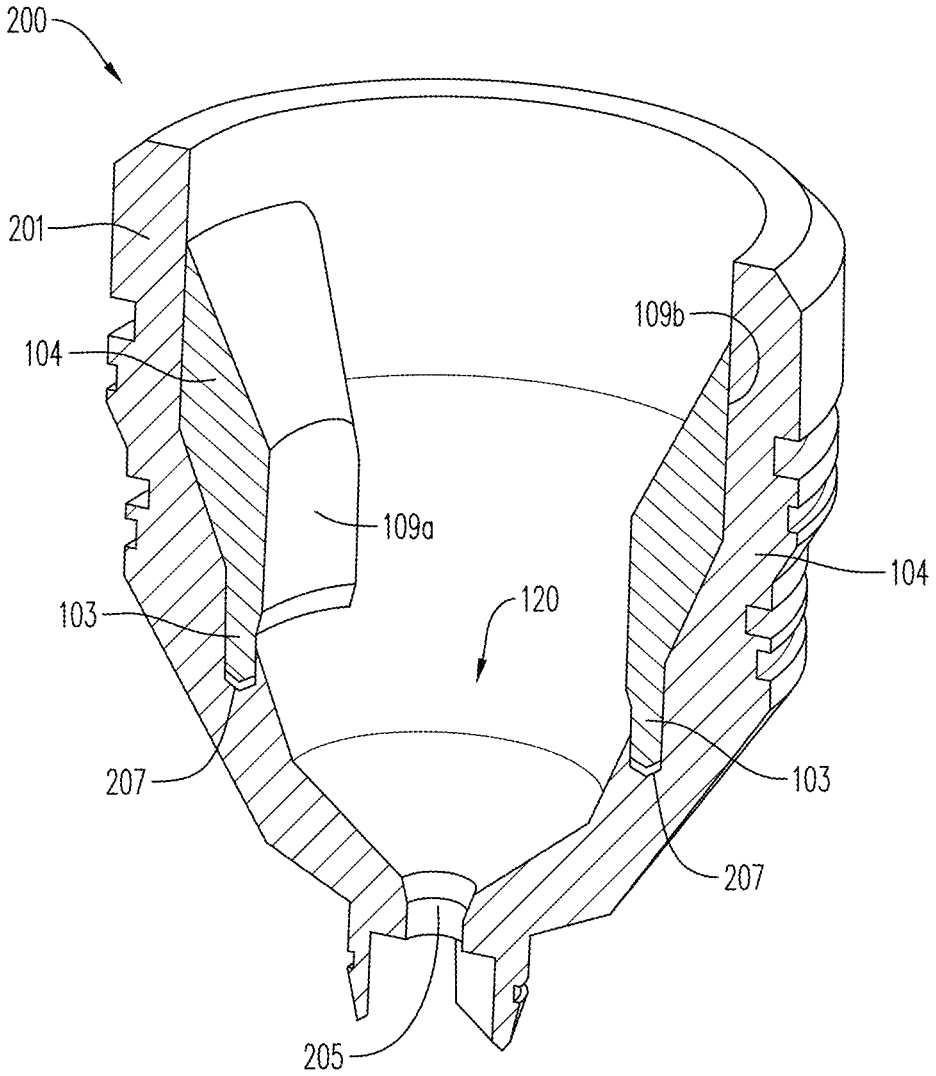
FIG. 2C is a cutaway view of a shaped charge including the adapter of FIG. 2A secured in a shaped charge case.

As illustrated in FIG. 2B, the surface features 207 may be configured as a dimple or a hole formed in the inner surface 204 of the shaped charge case 201. According to an aspect and as illustrated in FIG. 3D and FIG. 3E, the surface feature 207 may be configured as a slotted opening. The surface feature 207 may be arranged at the first or second surfaces 109*a*, 109*b*, such that the securing mechanism 103 can be received therein and the members 104 can be secured in the shaped charge case 201.

The securing mechanisms 103 may be positioned at one of a first end 105 and a second end 106 of the member 104. As seen for instance in FIG. 2C, the securing mechanism 103 extends downwardly from the second end 106 of the members 104 and is received in the surface feature 207 of the shaped charge case 201. The securing mechanism 103 may be configured as a protrusion or pin that extends from the second end 106. In an alternate embodiment and as seen in FIG. 3A, the securing mechanism 103 is configured as an elongated protrusion that extends outwardly from the second surface 109*b* of the member 104. According to an aspect, the elongated protrusion extends from the first end 105 and spans less than 50% the total length of the second surface 109*b* of the member 104. The elongated protrusion is configured to engage the internal surface feature 207, shown in FIG. 3D and FIG. 3E as a slotted opening, and affix the member 104 to the shaped charge case 201.

Figure 3B:
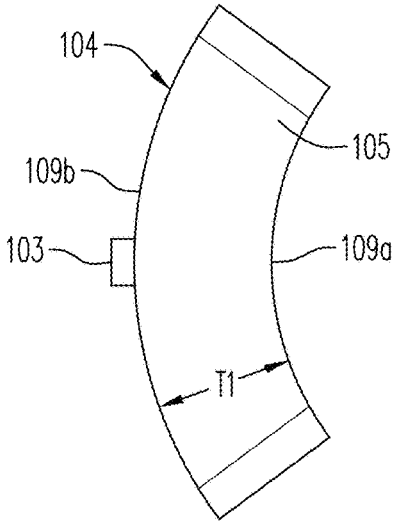
FIG. 3B is a top down view of the adapter of FIG. 3A.
Figure 3C:
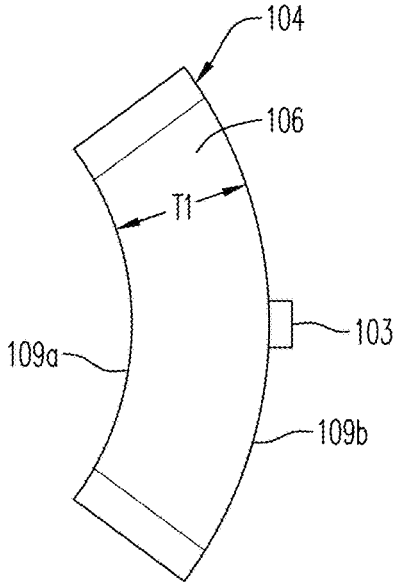
FIG. 3C is a bottom up view of the adapter of FIG. 3B.
Figure 3D:
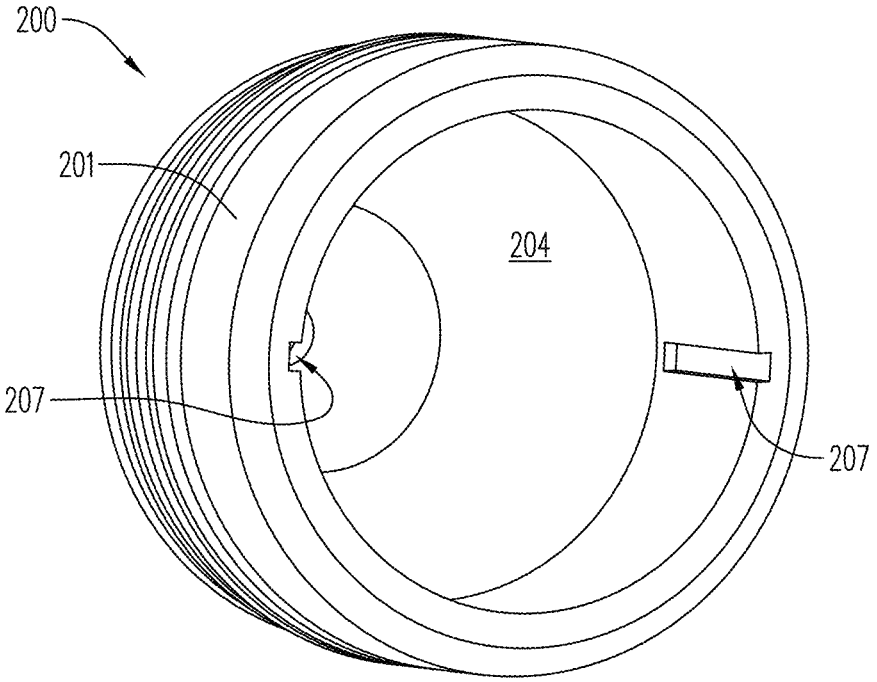
FIG. 3D is a top down, perspective view of a shaped charge configured for receiving and securing the adapter of FIG. 3A.
Figure 3E:
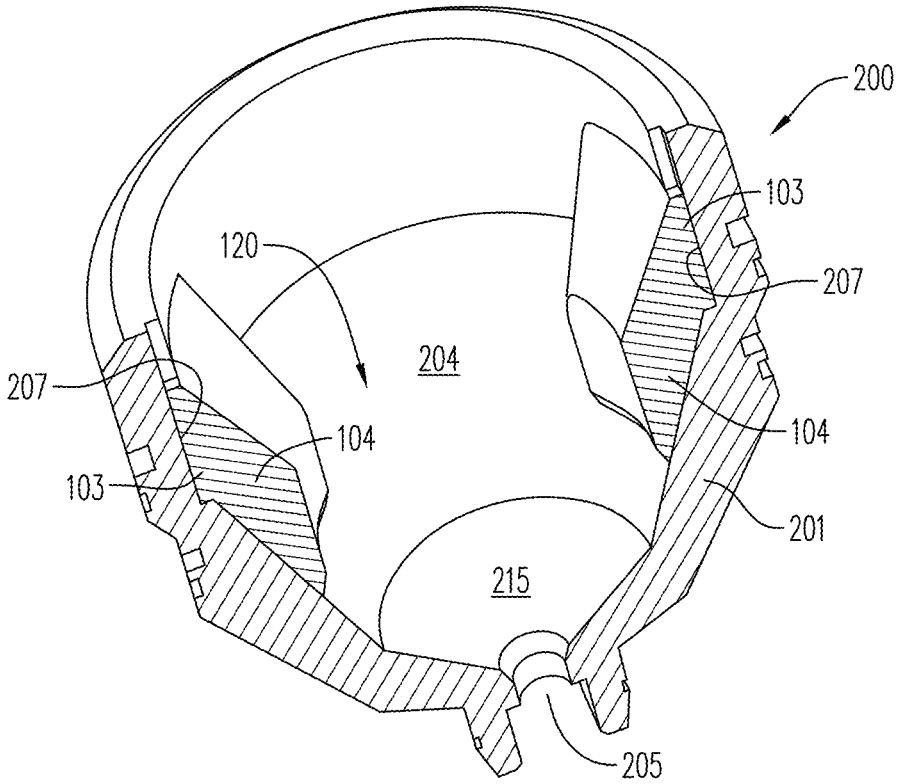
FIG. 3E is a cutaway view of a shaped charge including the adapter of FIG. 3A, illustrating securing mechanisms of the adapter engaged in internal surface features, according to an embodiment.

With reference to FIGS. 3A-3C, each member 208 is contoured to conform to a contour of the inner surface 204 of the shaped charge case 201. This changes the overall geometry of the hollow interior 203 of the shaped charge case 201 from a rotationally symmetric case to a mirror symmetric case due to the presence of the adapter 202. In other words, the geometry of the hollow interior 203 of the shaped charge case 201 is changed from simply looking the same after the shaped charge has been rotated to a configuration in which one half of the geometry of the hollow interior 203 of the shaped charge case 201 is the mirror image of the other half of the geometry of the hollow interior 203 of the shaped charge case 201. As would be understood by one of ordinary skill in the art, conical shaped charge cases are typically rotationally symmetric, while slotted/rectangular shaped charge cases are typically mirror symmetric. When installed in the shaped charge case 201, the members 208 are arranged such that the open area 120 between the members 208 is disposed over the initiation point 205 of the shaped charge case 201, as described above with respect to the central open area 120 of the adapter 100 shown in FIG. 2.

FIG. 3B shows one member of the plurality of members 104 from the first end 105. FIG. 3C shows one member of the plurality of members 104 from the second end 106. In both views, the members 104 have a uniform thickness T1. According to an aspect, each of the plurality of members 104 may be configured with a uniform thickness T1 or a non-uniform thickness (not shown) between the first end 105 and the second end 106.

Figure 4A:
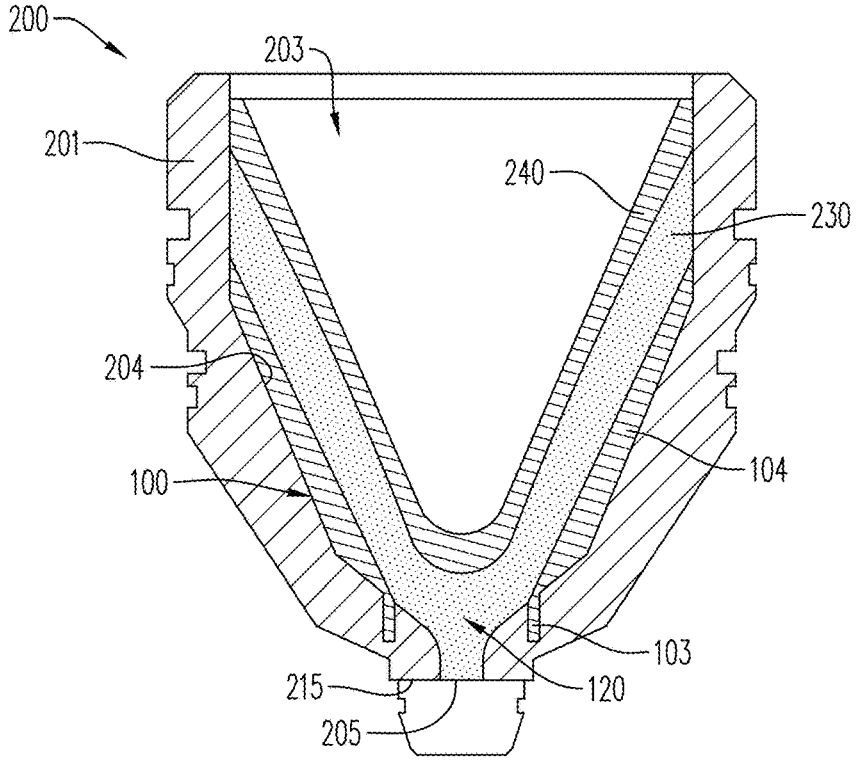
FIG. 4A is a cross-sectional view of a shaped charge including the adapter of FIG. 2A, an explosive load and a conical liner.
Figure 4B:
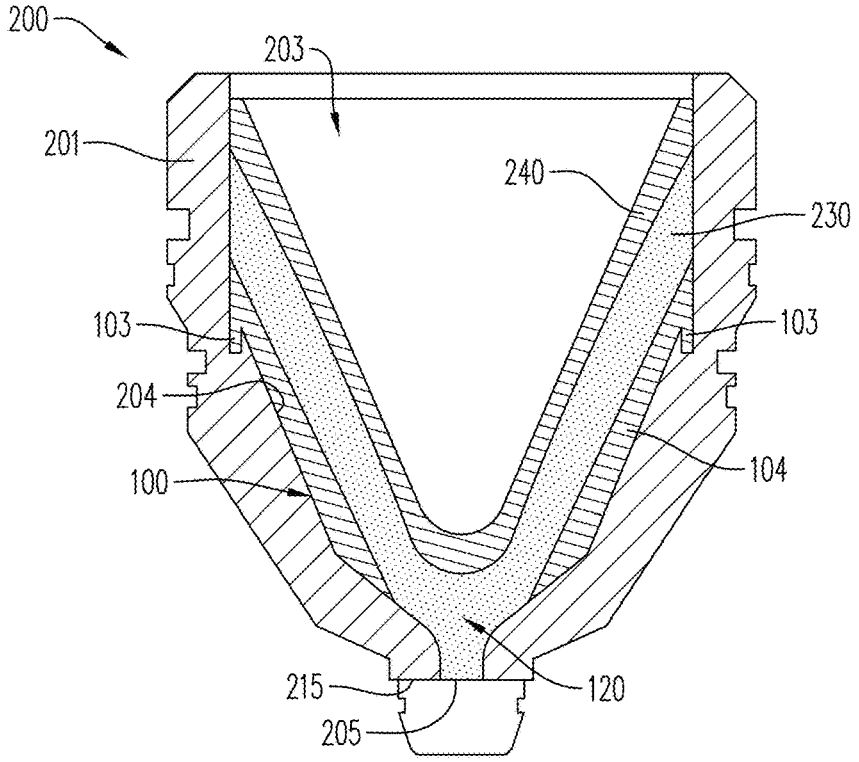
FIG. 4B is a cross-sectional view of a shaped charge including the adapter of FIG. 3A, an explosive load and a conical liner.

FIG. 4A and FIG. 4B illustrate the adapter 100 being positioned in a shaped charge 200. The shaped charge includes a shaped charge case 201 having a hollow interior 203. The adapter is positioned in the hollow interior 203 and its securing mechanisms 103 are secured to an inner surface 204 of the shaped charge case 201. Each member 104, configured substantially as described hereinabove with respect to FIG. 2A, FIG. 2C, FIGS. 3A-3C and FIG. 3E, is arranged in a spaced apart configuration from another member 104. This arrangement of the members 104 creates a central open area 120 of the adapter 100.

An explosive load 230 is disposed on top of the adapter 100 and substantially fills the central open area 120. The explosive load 230 extends along at least a portion of a back wall 215 of the shaped charge case 201, and over an initiation point 205 formed in the back wall 215. The initiation point 205 may be an aperture or depression formed in the back wall 215 of the shaped charge case 201. When a detonating cord positioned adjacent the initiation point 205 is initiated, a detonation wave (or initiation energy produced upon initiation of the detonating cord) travels along the detonating cord to the initiation point 205, and ultimately to explosive load 230 (including explosive powder) housed in the shaped charge case 201.

A liner/conical liner 240 is positioned over the explosive load. When the shaped charge 200 is initiated, the explosive load 230 detonates and creates a detonation wave that causes the liner 240 to collapse and be expelled from the shaped charge case 201. The expelled liner 240 produces a forward-moving perforating jet that moves at a high velocity. The resulting perforating jet, the shape of which is altered due to the displacement of some of the explosive load 230 by the adapter 100, creates an atypical perforation hole in a target relative to a substantially similar shaped charge without an adapter.

As described in further detail hereinbelow, the atypical perforation hole may be a slotted or elliptical perforation hole. As described hereinabove, elliptical or slotted perforations may be particularly useful in forming overlapping rectangular slots to allow full 360-degree access through a wellbore casing to flow concrete and seal a wellbore upon abandonment. In addition, the elliptical or slotted perforations are flow optimized and may be ideal for fracturing applications, which include the injection of fluid into the underground formation to force open cracks or fissures in the formation. This helps to reduce the breakdown pressure of a formation. The elliptical or slotted perforations may overlap each other in a helical pattern, thereby facilitating the 360° perforation of a cylindrical target. It is contemplated that the atypical perforation hole may have other shapes, at least based in part by the quantity of members 104, as described in further detail hereinbelow.

FIG. 4B illustrates the securing mechanisms 103 extending from a top portion of the adapter 100, as opposed to extending from a bottom portion of the adapter 100 as shown in FIG. 4A. It is contemplated that securing mechanisms 103 may extend from the top portion and the bottom portion of the adapter 100, as well as any position between the top portion and the bottom portion.

Figure 5:
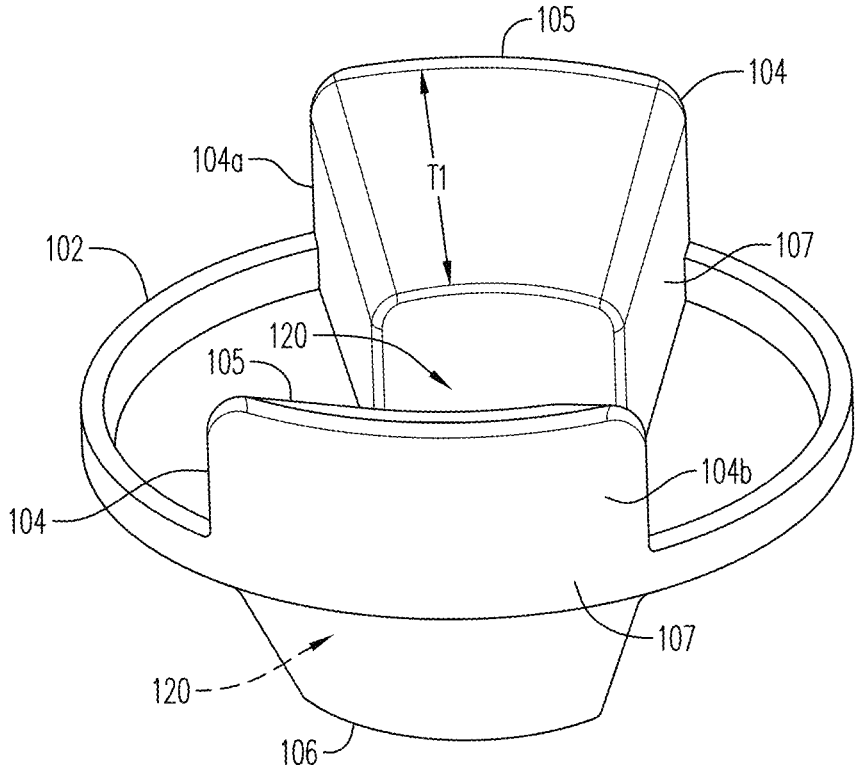
FIG. 5 is a perspective view of an adapter for a shaped charge, illustrating the adapter having a collar connecting a plurality of members, in accordance with an embodiment.

FIG. 5 illustrates a perspective view of another configuration of an adapter 100 for use with a shaped charge. The adapter 100 may be particularly suited for being secured within a hollow interior of a shaped charge case. According to an aspect and as described hereinabove with respect to FIGS. 2A and 3A, the adapter 100 may be formed from an inert material that does not react with the materials/components of the shaped charge.

The adapter 100 includes a collar 102 and a plurality of members 104*a*, 104*b* (also referred to collectively as members 104) extending from or otherwise secured to the collar 102 in a spaced apart configuration from each other. The collar 102 and the members 104 may be 3D printed, injection molded or machined. According to an aspect, the collar and members may be formed of the same materials or may be formed together as a single structure. The collar 102 couples the plurality of members 104 and maintains the members 104 in a spaced apart configuration from each other, such that when the adapter 100 is inserted into a shaped charge case, the collar 102 maintains the position of the members 104 in the shaped charge case. The members 104 may be configured substantially as illustrated in FIGS. 2A, 2C, 3A-3C and 3E and described hereinabove, thus for purposes of convenience and not limitation, the various features of the members 104 are not repeated here.

According to an aspect, the collar 102 and the plurality of members 104 are configured for being secured to an inner surface of the shaped charge case. As illustrated in FIG. 5, for example, the members 104 are arranged on the collar 102 so that the adapter 100 has a central open area 120. The central open area 120 allows explosive powder/explosive load used in shaped charges to fill the space in between the members 104 to facilitate formation of a detonation wave (described in detail hereinabove with respect to FIGS. 4A-4B).

Each of the plurality of members 104*a*, 104*b* has a first end 105 and a second end 106 spaced apart and opposite from the first end 105. The collar 102 may be secured to a substantially central portion 107 of each member 104*a*, 104*b*, between the first and second ends 105, 106. According to an aspect, the collar 102 may extend from or be otherwise secured to any desired position along the length of the members 104*a*, 104*b*. As used herein, first end, second end, central portion, and other descriptions related to relative locations on the exemplary members described throughout this disclosure are for aiding in the description of the associated configurations and do not limit or constitute limiting delineations of any portion(s) of the exemplary members/adapters, unless otherwise indicated.

The size of the collar 102 and the size of the members 104 may be selected based on the needs of the application in which the shaped charge they are secured to will be used. According to an aspect, the collar 202 and members 104 may be sized according to the internal diameter of the shaped charge case in which they are to be secured. Each of the plurality of members 104 may span about 20 degrees to about 100 degrees of a circumference of the collar 102. According to an aspect, each member 104 spans 60 degrees of the circumference of the collar 102.

According to an aspect, the members include a first member 104*a* and a second member 104*b*. The first and second members 104*a*, 104*b* may be spaced 180 degrees away from each other on the collar 102 (i.e., when measurements are taken from the central portion of the width of each member 104). According to another exemplary embodiment, the members 104*a*, 104*b* may be spaced, e.g., 90 degrees away from each other on the collar 102. While two members 104 are shown, it is contemplated that an embodiment may include more than 2 members.

According to an aspect, the adapter 100 is a symmetrical adapter by virtue of each member (such as two members 104*a*, 104*b*) being mirror images and equally spaced apart from each other on the collar 102. Each of the plurality of members 104 may be configured with a uniform thickness T1 (FIG. 3B) or a non-uniform thickness (not shown) between the first end 105 and the second end 106. According to an aspect, when the members 104 have a non-uniform thickness, the thickness of the substantially central portion 107 of the members 104 is greater than the thickness of the first end 105 and greater than the thickness of the second end 106. This may help to ensure that that the members 104 are properly secured to the collar 102, when the collar 102 and the members 104*a*, 104*b* are formed as two separate structures.

Figure 6A:
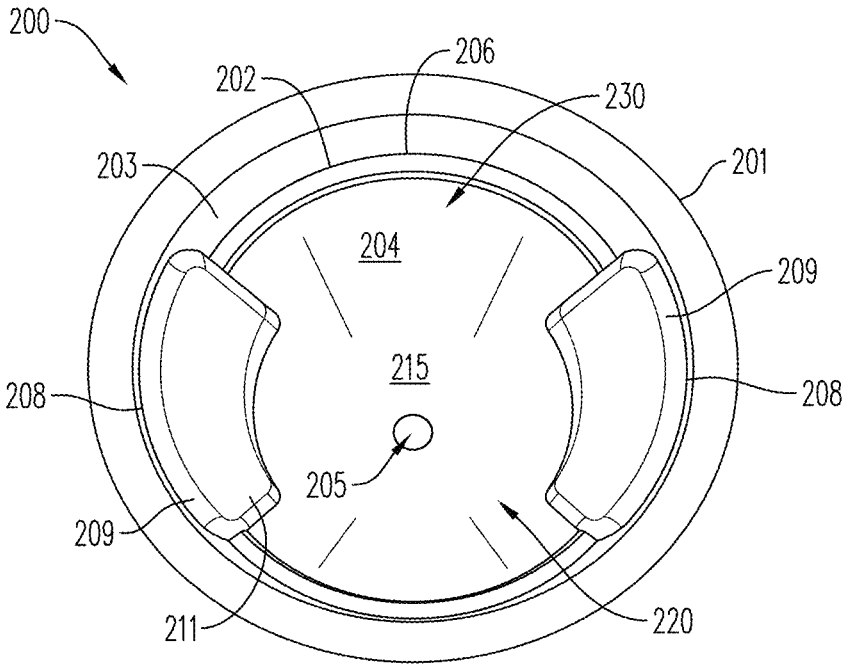
FIG. 6A is a top, perspective view of a shaped charge having the adapter of FIG. 5 positioned therein, in accordance with an embodiment.
Figure 6B:
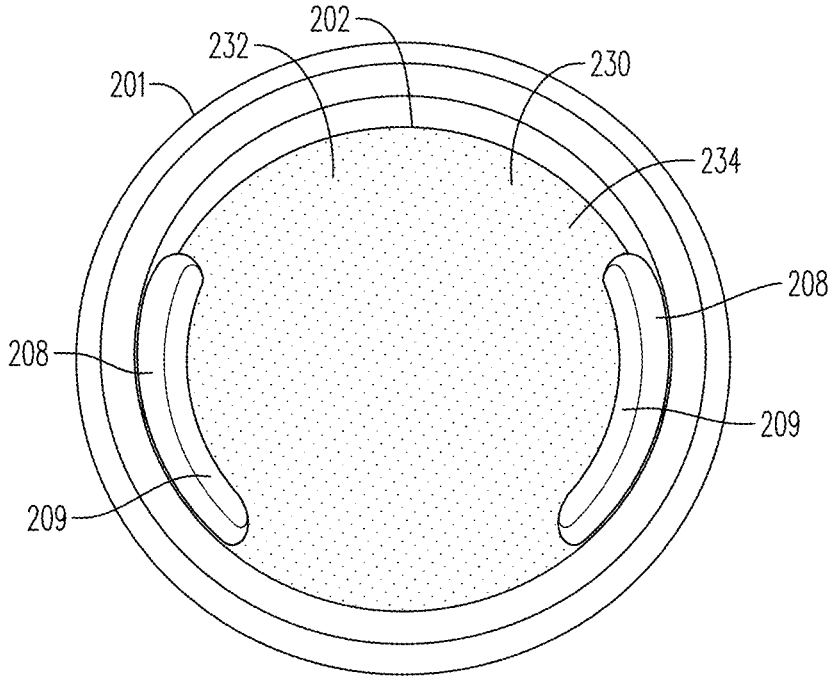
FIG. 6B is a top, perspective view of the shaped charge of FIG. 6A, illustrating an explosive load partially covering the adapter.
Figure 6C:
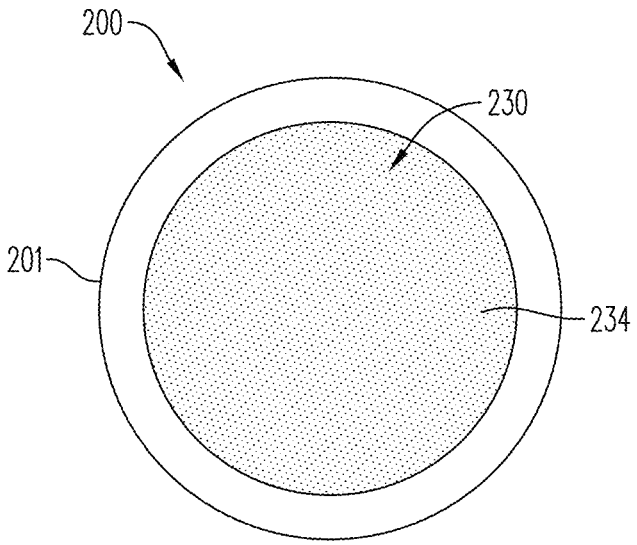
FIG. 6C is a top view of the shaped charge of FIG. 6B, illustrating the explosive load completely covering the adapter.

Further embodiments of the disclosure are associated with a shaped charge/conical shaped charge 200 configured to create atypical perforation hole geometries in a target. FIGS. 6A, 6B and 6C illustrate top views of the shaped charge 200, in accordance with an embodiment. The shaped charge 200 includes a shaped charge case 201 formed from at least one of machinable steel, aluminum, stainless-steel, copper, zinc, and the like. As illustrated in FIG. 6A, the shaped charge case 201 has an initiation point 205 formed in a back wall 215 of the case 201.

According to an aspect, an inner surface 204 of the shaped charge case 201 defines an overall geometry of a hollow interior 203 (FIG. 6A) of the shaped charge case 201. The hollow interior 203 is configured to house one or more of an adapter/insert/internal inlay 202, the explosive material 230, and a liner 240 (FIG. 6A). The use of the exemplary shaped charges 200 and adapters 100, 202 may also aid in the reduction of gun swells (often leading to total loss of the perforating gun and the shaped charges secured therein), by virtue of the partial replacement of explosive and, consequently, a reduction of the explosive energy of the shaped charge. The reduction of the explosive energy generates less pressure, which reduces the well of a perforating gun.

According to an aspect, the inner surface 204 of the shaped charge case 201 defines a conical or substantially frustoconical interior volume and the overall shape and volume of the hollow interior 203 of the shaped charge case 201 is modified by the adapter 202. The shaped charge 200 includes the adapter 202 secured to the inner surface 204 of the shaped charge case 201. The adapter 202 includes a collar 206 and a plurality of members 208 extending from or otherwise secured to the collar 206 in a spaced apart configuration from each other. In this arrangement, the members 208 are disposed about the collar 206, such that the adapter 202 has a central open area 220.

FIGS. 6A-6B and FIGS. 7A-7B, for example, illustrate an adapter 202 housed within the hollow interior 203 and secured to the inner surface 204 of the shaped charge case 201. The adapter 202 is configured substantially as the adapter 100 described hereinabove and illustrated in FIG. 5. Thus, for purposes of convenience and not limitation, similar features of the adapter 100 illustrated in FIG. 2 and the adapter 202 are not repeated hereinbelow.

As illustrated in FIG. 6A, the adapter 202 includes a collar 206. A plurality of members 208 (FIG. 4A) extend from or are otherwise secured or otherwise coupled to the collar 206. The adapter 202 may be coupled to the inner surface 204 of the shaped charge case 201 by, for example and without limitation, adhesives, or may be rigidly secured in place within the inner surface by friction fit, clamps, adhesives, clips, welding, or other known techniques. It is contemplated that the adapter 202 may be secured in the shaped charge case 201 by virtue of the additional components of the shaped charge (explosive load, liner, and the like) being pressed on top of the adapter 202. According to an aspect, the collar 206 may be frictionally secured to the inner surface 204 of the shaped charge case 201, while the members 208 are not separately secured to the shaped charge case 201. In an embodiment, at least one of the collar 206 and the plurality of members 208 are affixed to the inner surface 204 of the shaped charge case 201 by an adhesive or by securing mechanisms, such as a protrusion or pin that extends from one or each member 208. Such securing mechanisms may be configured substantially as described hereinabove with respect to FIGS. 2A, 2C, 3A-3C and 3E, thus for purposes of convenience and not limitation, those securing mechanisms are not repeated here.

FIG. 6B and FIG. 6C illustrate an explosive load 230 disposed in/received within the hollow interior 203 of the shaped charge case 201. The explosive load 230 is in direct contact with at least a portion of/certain areas of the inner surface 204 of the shaped charge case 201. In these configuration(s), the adapter 202 is adjacent to other portions of the inner surface 204 of the shaped charge case 201 so that it effectively displaces the explosive load 230 that would otherwise occupy those spaces. For example, at least a portion of the members 208 displaces a portion of the explosive load 230 that would otherwise occupy the volume occupied by the members 208 within the hollow interior 203 of the shaped charge case 201. The collar 206 may also displace a portion of the explosive load 230. In manufacturing such a shaped charge 200, it is expected that less explosive material will be required, which may help reduce costs associated with manufacturing the shaped charge.

Figure 8A:
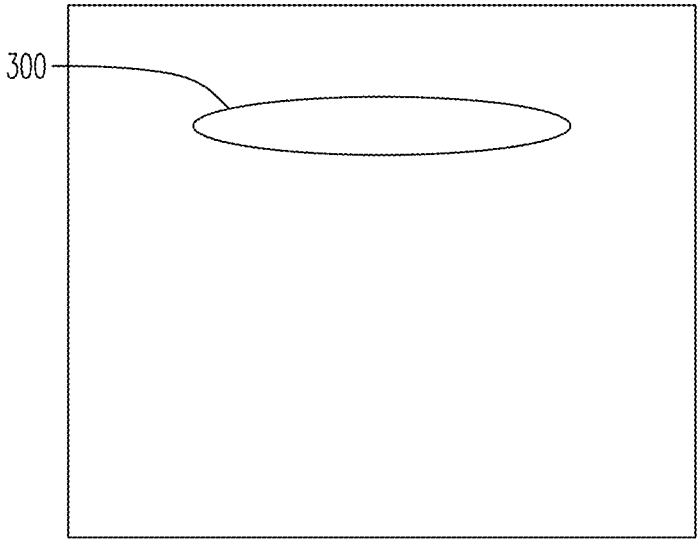
FIG. 8A illustrates a perforation hole geometry created upon detonation of a conical shaped charge including an adapter, in accordance with an embodiment.
Figure 8B:
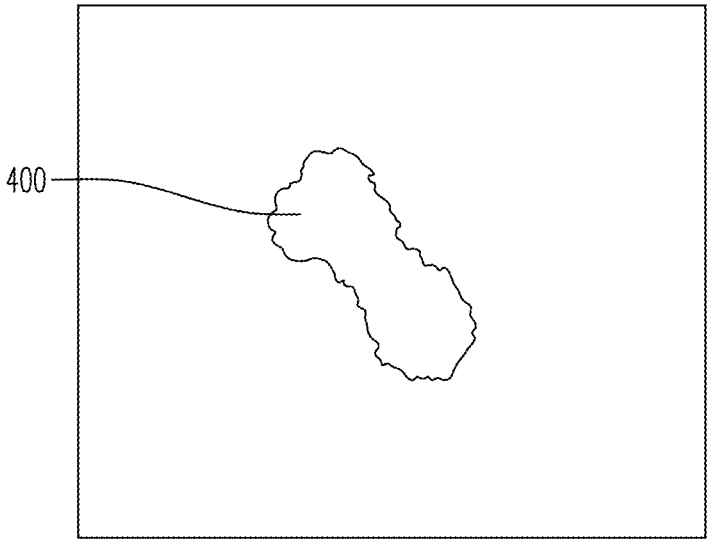
FIG. 8B illustrates a perforation hole geometry created upon detonation of a conical shaped charge including an adapter, in accordance with an embodiment.

The portion(s) of the adapter 202 that displace some of the explosive load 230 defines a shape and a corresponding distribution of the explosive load 230 that, upon detonation of the shaped charge 200, produces an atypical perforating jet geometry and resultant perforation hole geometry as compared to a perforating jet/perforation hole geometry produced by the shaped charge 200 in the absence of the adapter 202. For example, the typical conical shaped charge 10 (FIG. 1A) without an adapter produces the round perforation hole 50 shown in FIG. 1C. On the other hand, the conical shaped charge 200 including the adapter 202 as shown in FIG. 6A, having two members 208, produces an elongated perforation hole geometry. Such elongated perforation hole geometry may be an elliptical perforation hole 300 (e.g., as shown in FIG. 8A) or a slotted-type perforation hole 400 (e.g., as shown in FIG. 8B) despite the case 201 having a substantially similar geometry as the case 20 of the typical conical shaped charge 10. The shape of the perforation hole may depend on the distance between the shaped charge and the target/target formation. For instance, a first shaped charge 200 (including adapter 202) that is close to the target results in an elliptical perforation hole 300, while a second shaped charge 200 that is further away from the target that the first shaped charge results in a rectangular perforation hole. It is contemplated that shaped charges 200 positioned at distances greater than the distance of a second shaped charge may result in a perforation hole that is substantially rectangular, and includes a waisted portion at a central distance along the length of the rectangular perforation hole. The elliptical or slotted perforation hole is useful in forming overlapping rectangular or linear slots to allow full 360-degree access through a wellbore casing to flow concrete and seal a wellbore upon abandonment. As described hereinabove, the elliptical or slotted perforation hole may be suitable for hydraulic fracturing applications.

According to an aspect, the explosive load 230 may include a first layer/first explosive layer 232 of explosive and a second layer/second explosive layer 234 of explosive. The first explosive layer 232 may be disposed adjacent the back wall 215 and initiation point 205 of the shaped charge 200, as well as at least a portion of the adapter 202. The first explosive layer 232 may be more sensitive to initiation than the second explosive layer 234.

As illustrated in FIG. 6B, for example, a first layer 232 of the explosive load 230 covers a portion of the adapter 202. At least a portion of the members 208 are still visible. According to an aspect, the first layer 232 is disposed over the adapter 202 so that it at least partially covers the adapter 202 and the second layer 234 of explosive is loosely disposed on top of the first layer 232 so that it fully covers the adapter 234. Both layers 232, 234 may be pressed together onto the adapter 202. According to an aspect, the first and second layers 232, 234 may be separately pressed onto the adapter once they are disposed in the shaped charge case 201.

FIG. 6C illustrates that the second layer 234 of explosive may be disposed on top of the first layer 232 of explosive and pressed onto the first layer 232 to ensure that there are no gaps between the explosive load 230 and the adapter 202. Pressing any one of the first and second layers 232, 234 helps to ensure that the explosive load is properly distributed in the hollow interior 203 of the case 201, in order to facilitate the collapse of a liner disposed on top of the explosive load 230 and penetration of a resulting perforating jet into a target or formation. According to an aspect, the second layer 234 of explosive load may help to ensure that the first layer 232 remains in place, however, the adapter 202 will still affect the general configuration of the explosive load 230 in the shaped charge case 201 and the shaped charge will still result in an atypical perforation shape (such as an elliptical or slotted perforation).

According to an aspect, the explosive load 230 includes a plurality of powders. Such powders may include at least one of pentaerythritol tetranitrate (PETN), cyclotrimethylenetrinitramine (RDX), octahydro-1,3,5,7-tetranitro-1,3,5,7-tetrazocine/cyclotetramethylene-tetranitramine (HMX), 2,6-Bis(picrylamino)-3,5-dinitropyridine/picrylaminodinitropyridin (PYX), hexanitrostibane (HNS), triaminotrinitrobenzol (TATB), and PTB (mixture of PYX and TATB). According to an aspect, the explosive load 230 includes diamino-3,5-dinitropyrazine-1-oxide (LLM-105). The explosive load 230 may include a mixture of PYX and triaminotrinitrobenzol (TATB). The type of explosive material used may be based at least in part on the operational conditions in the wellbore and the temperature downhole to which the explosive may be exposed. According to an aspect, the first layer 232 and the second layer 234 of explosive load may include the same type of explosive material or explosive powder. According to an aspect, the first layer 232 includes at least one of HNS, LLM-105, PYX, and TATB, while the second layer 234 includes a binder and at least one of HNS, LLM-105, PYX, and TATB.

Figure 7A:
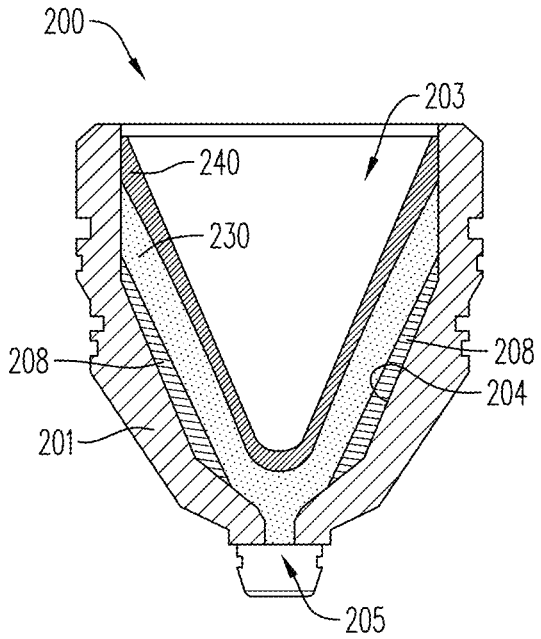
FIG. 7A is a cross-sectional view of a conical shaped charge having the adapter of FIG. 5 positioned therein, according to an embodiment.

According to an aspect, and as illustrated in FIG. 7A, the shaped charge 200 includes a pre-pressed liner/pressed metal powder/conical liner 240 disposed atop the explosive load 230. The general shape of the conical liner 240 is illustrated in FIG. 7A. As would be understood by one of ordinary skill in the art, the liner 240 may be formed from a variety of powdered metallic and non-metallic materials and/or powdered metal alloys, and binders. According to an aspect, the liner 240 is formed from copper, pressed to form the desired liner shape. In certain exemplary embodiments, the liner material(s) may include an inert material, where an inert material may be a material that does not participate in a chemical reaction, including an exothermic chemical reaction, with the liner 240 and/or other components of the shaped charge including elements created as a result of a detonation of the shaped charge. In the same or other embodiments, the liner material may include an energetic material, where an energetic material may be a material that is capable of a chemical reaction, including an exothermic chemical reaction, with one or more components of the liner 240 and/or other components of the shaped charge including elements created as a result of a detonation of the shaped charge. Typical liner constituents and formation techniques are further described in commonly-owned U.S. Pat. No. 9,862,027, which is incorporated by reference herein in its entirety to the extent that it is consistent with this disclosure. When the shaped charge 200 is initiated, the explosive load 230 detonates and creates a detonation wave that causes the liner 240 to collapse and be expelled from the shaped charge case 201. The expelled liner 240 produces a forward-moving perforating jet that moves at a high velocity. The resulting perforating jet, the shape of which is altered due to the displaced explosive load 230, creates an atypical perforation hole in a target.

Figure 7B:
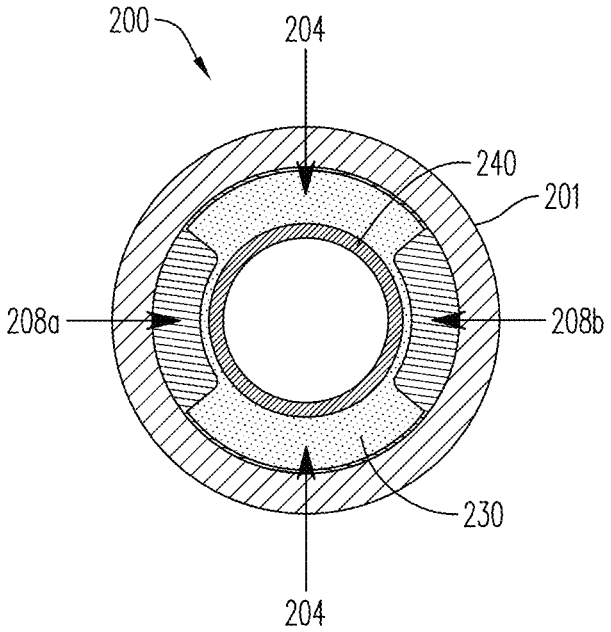
FIG. 7B is a cutaway view of the shaped charge of FIG. 7A.

According to an aspect and as illustrated in FIG. 7B, the explosive load 230 is not uniformly distributed within the hollow interior 203 of the shaped charge case 201 due to the presence of the adapter 202. Thus, different magnitudes of explosive force may be generated at different locations within the hollow interior 203 depending on the amount of explosive at a particular location. The geometry of the perforating jet and resulting perforation are, at least in part, a function of the distribution of these explosive forces. As such, adapters 100, 202 according to this disclosure may be particularly designed for distributing an explosive load/explosive force profile to achieve to a desired perforation geometry, such as the slot or elliptical shaped geometry formed as a result of two members secured to the inner surface 204 of the shaped charge case 201 in a spaced apart distance from each other.

FIG. 8A and FIG. 8B illustrate an exemplary perforation shape generated by the shaped charge 200 including the adapter 202 and the conical liner 240. Upon detonation of the shaped charge 200, the liner 240 is expelled out of the shaped charge case 201 in a partially deformed configuration (or jet of material) relative to the expelled configuration of the same liner in a shaped charge without the adapters 100/202 disclosed herein. As illustrated in FIG. 8A, the perforation shape is altered from that of a standard round perforation hole and may result in an elliptical shape 300.

According to an aspect an as illustrated in FIG. 8B, the perforation shape is altered from that of a standard round perforation hole and may result in a slot/rectangular shape 400 perforation/entrance opening in a casing/target.

Figure 9A:
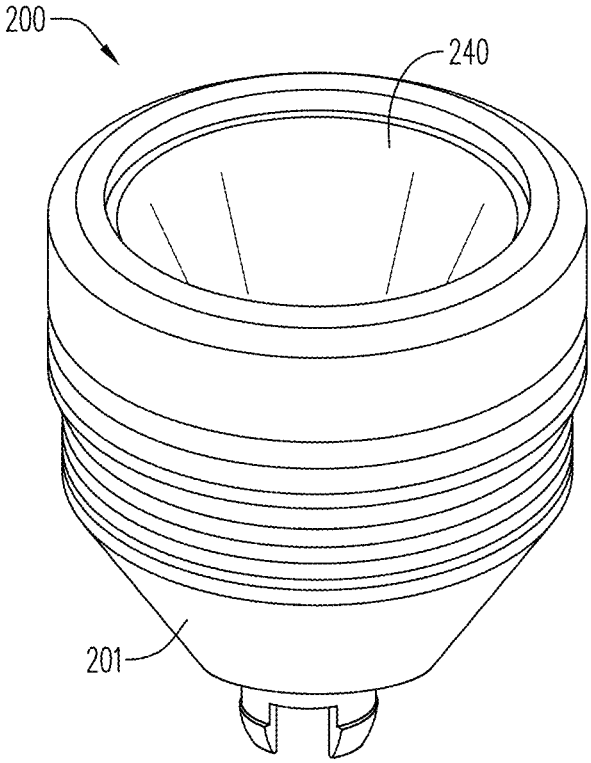
FIG. 9A is a perspective view of a conical shaped charge, according to an embodiment.
Figure 9B:
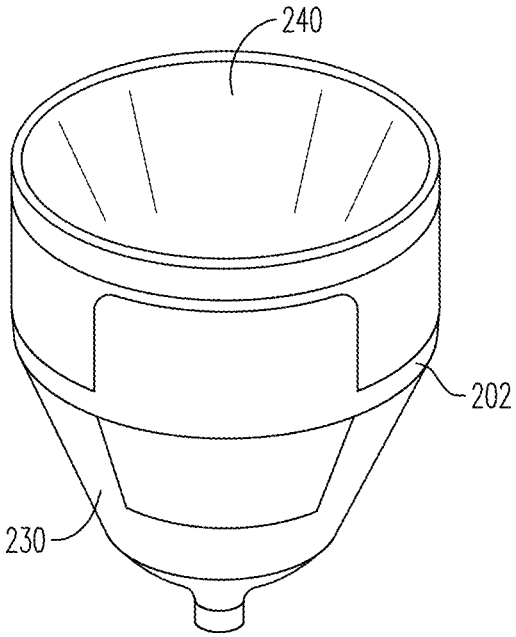
FIG. 9B is a perspective view of an adapter, an explosive load and a liner configured for being positioned in the shaped charge of FIG. 9A.
Figure 9C:
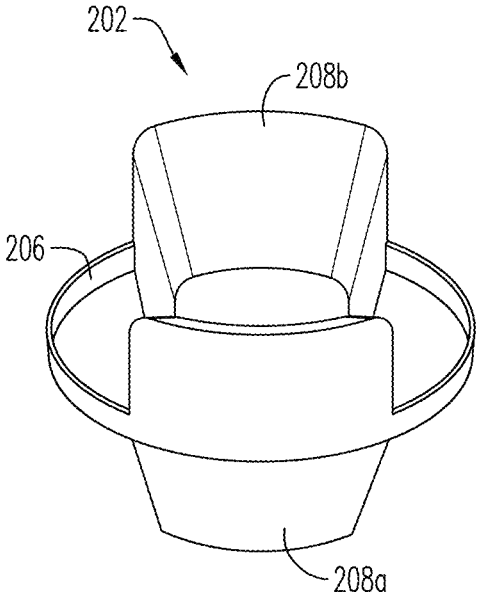
FIG. 9C is a perspective view of the adapter of FIG. 9B.

FIGS. 9A-9C schematically illustrate various views of the components of the shaped charge 200. FIG. 9A illustrates an assembled shaped charge 200 having the liner 240 secured within the shaped charge case 201. While not visible in the assembled shaped charge 200 illustrated in FIG. 9A, an adapter and explosive load is housed in a hollow interior of the shaped charge case 201.

FIG. 9B illustrates the general arrangement of the liner 240 when disposed atop the explosive load 230, and the explosive load 230 when disposed atop the adapter 202.

FIG. 9C illustrates the general arrangement of illustrates an isolated view of the adapter 202. As described in detail hereinabove, the adapter 202 includes a collar 206 and two members 208*a*, 208*b* (collectively members 208) coupled or otherwise secured to the collar 206.

Figure 10:
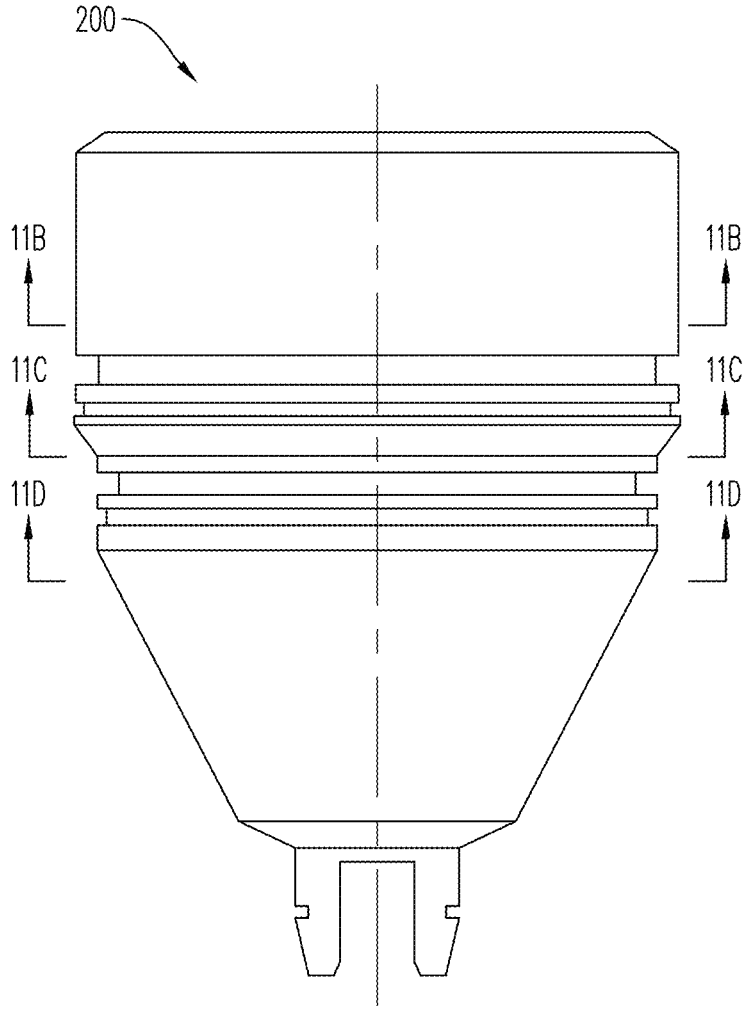
FIG. 10 is a side view of a conical shaped charge including the adapter of FIG. 9C, in accordance with an embodiment.

FIG. 10 illustrates a side view of a conical shaped charge 200. While not shown in FIG. 10, the conical shaped charge 200 includes the adapter 202, explosive load and liner 240 described hereinabove and illustrated in FIG. 7A.

Figure 11A:
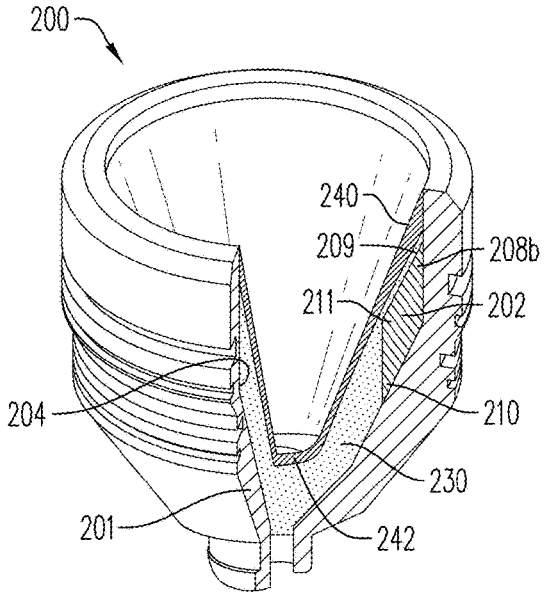
FIG. 11A is a cutaway view of the shaped charge of FIG. 10, in accordance with an embodiment.

FIG. 11A is a cut through view of the shaped charge 200 of FIG. 10. At least a portion of the explosive load 230 is adjacent the inner surface 204 of the case 201, while remaining amounts of the explosive load 230 are adjacent only the adapter 202. As described hereinabove, the inner geometry of the shaped charge 200 is changed from a rotational symmetric inner contour to a mirror symmetric contour due to presence of the adapter 202 which has a plurality of members in a mirror symmetric contour as previously discussed.

Figure 11B:
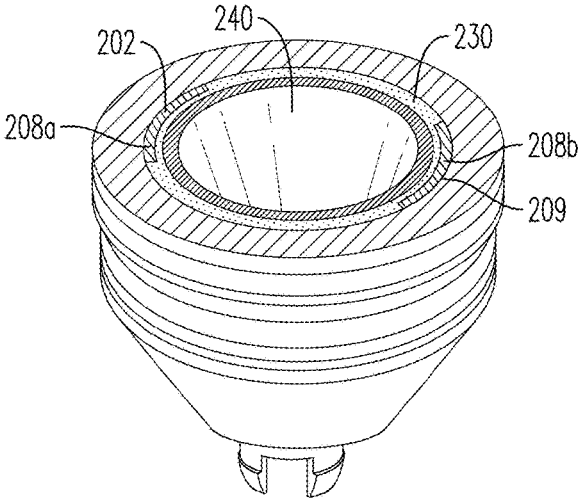
FIG. 11B is a cross-section view of the shaped charge of FIG. 10, taken along lines B-B.
Figure 11C:
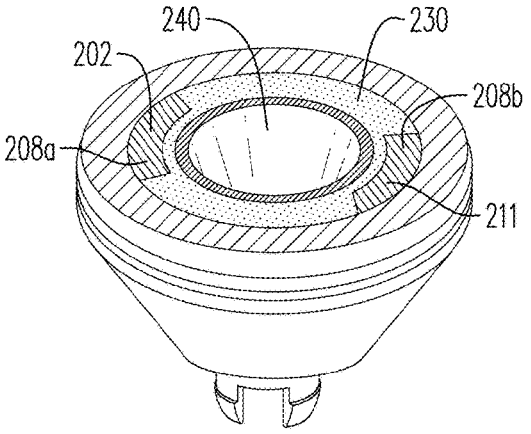
FIG. 11C is a cross-section view of the shaped charge of FIG. 10, taken along lines C-C.
Figure 11D:
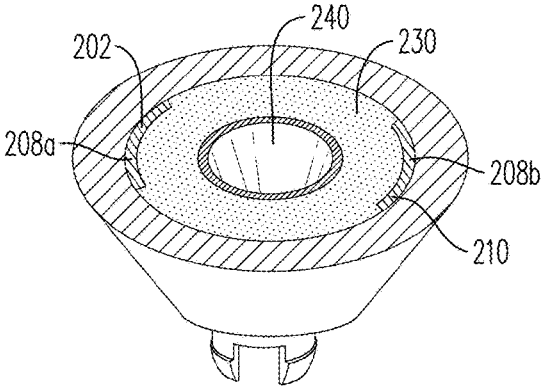
FIG. 11D is a cross-section view of the shaped charge of FIG. 10, taken along lines D-D.

FIGS. 11B-11D illustrate additional cut through views of the shaped charge of FIG. 10 and illustrate that the thickness of the members of the adapter may vary along its length. As illustrated in FIG. 11B, the first end/upper end 209 of each member 208*a*, 208*b* may have a thickness that is less than a thickness of the substantially central portion 211 (i.e., the region closest to the collar 206) (FIG. 11C) of the respective member 208*a*, 208*b*.

Similarly, as illustrated in FIG. 11D, a thickness of the second end 210 of each member 208*a*, 208*b* may be less than the thickness of the substantially central portion 211 (FIG. 11C) of the respective member 208*a*, 208*b*. The second ends 210 of the members 208 are closest to the apex 242 of the liner 240 and surrounded by the largest quantity of explosive load 230. According to an aspect, this allows the explosive force generated upon initiation of the shaped charge to be highest at the central open area of the adapter 202 and generally at the positions of the collar 206 (FIG. 6C) that do not accommodate members 208.

Figure 12A:
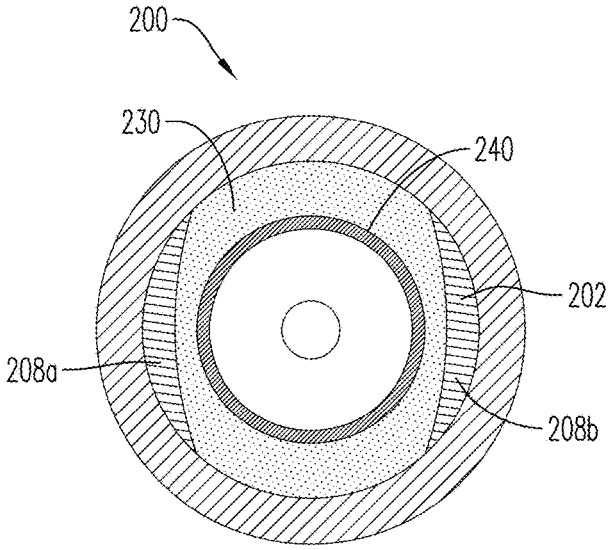
FIG. 12A is a cross-section view of a shaped charge including an adapter, illustrating the adapter having an elliptical cross-section, according to an embodiment.
Figure 12B:
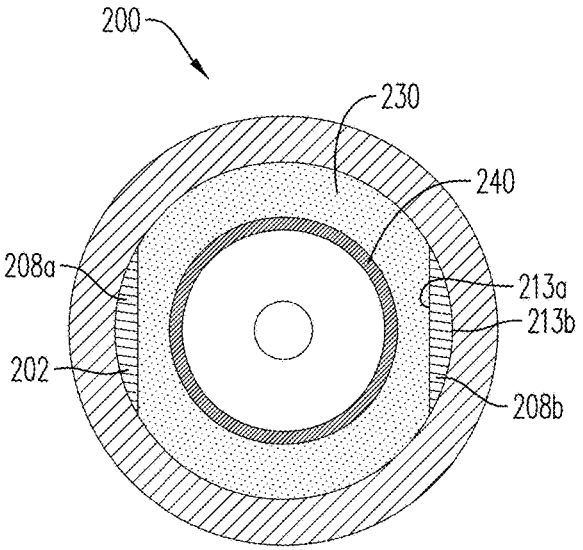
FIG. 12B is a cross-section view of a shaped charge including an adapter, illustrating the adapter having a straight cross-section, according to an embodiment.
Figure 12C:
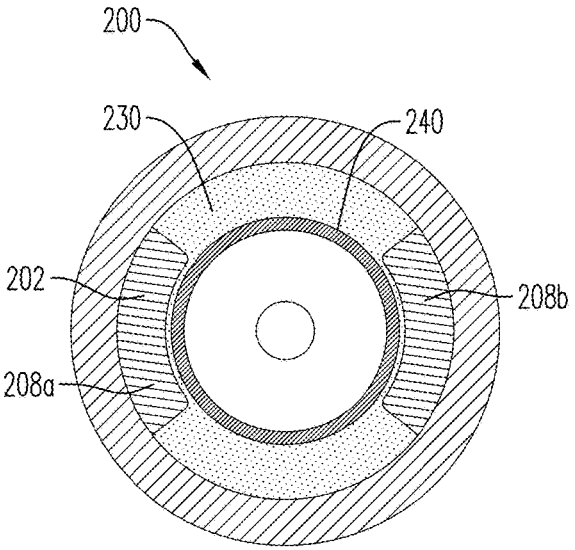
FIG. 12C is a cross-section view of a shaped charge including an adapter, illustrating the adapter having a block cross-section, according to an embodiment.

FIGS. 12A-12C illustrate top views of shaped charges 200 having adapters 202 secured therein. Each adapter 202 is illustrated as having members 208 with different cross-sectional shapes. FIG. 12A illustrates members 208 having a crescent-shaped cross-section.

FIG. 12B illustrates members 208 having a substantially planar cross-section on a first side 213*a* and a curved surface on an opposite, second side 213*b* that adapts to the contours of the inner surface 204 of the shaped charge case 201.

FIG. 12C illustrates members 208 having a substantially rectangular or block-shaped cross-section. The general shape and various dimensions of the members 208 may be adapted to create a wide variety of perforating geometries for particular applications and sizes of shaped charge cases in which the adapter 202 is to be secured.

According to an aspect, a detonating device, such as a detonating cord or a booster, may be in contact or communication with the explosive load 230 through an initiation point formed in the back wall/closed end of the shaped charge case 201, to initiate detonation of the shaped charge 200. According to an aspect, the initiation point may be an aperture or depression formed in the back wall. When the detonating cord is initiated, a detonation wave (or initiation energy produced upon initiation of the detonating cord) travels along the detonating cord to the initiation point, and ultimately to the explosive load 230. The explosive load 230 detonates and creates a detonation wave, which generally causes the liner 240 to collapse and be ejected from the case 201, thereby producing a forward moving perforating jet. The adapter 202 secured to the inner surface 204 of the shaped charge case 201 impacts the shape of the perforating jet by interfering with the detonation/ballistic wave in a manner that produces an atypical perforation hole geometry in a target. Such atypical perforation hole geometries may be a slot/rectangular hole formed by a conical shaped charge, rather than the typical circular perforation hole geometry formed when conical shaped charges are initiated without an adapter. It is contemplated that more than two members may be included on the collar of the adapter, which may result in other perforation hole geometries. According to an aspect, an adapter including three members spaced apart from each other may form a triangle-shaped perforation hole geometry, an adapter including four members spaced apart from each other may form an X-shaped perforation hole geometry, an adapter including five members spaced apart from each other may form a star-shaped perforation hole geometry, and an adapter including six members spaced apart from each other may form a daisy-shaped perforation hole geometry.

Figure 13:
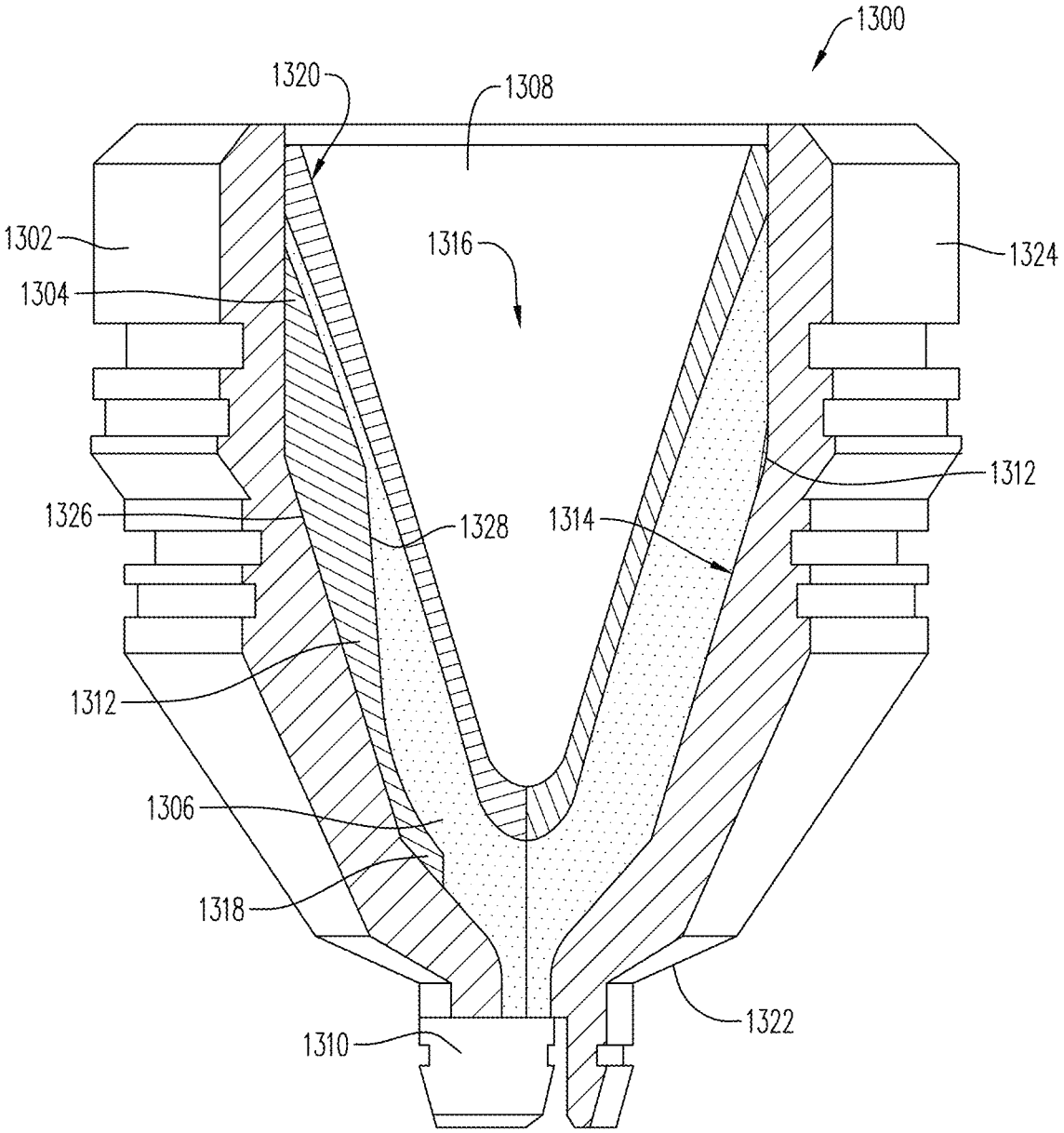
FIG. 13 is a cross-section view of a shaped charge including an adapter, according to an embodiment.

FIG. 13 illustrates a cross-section view of a shaped charge 1300. The shaped charge 1300 includes a shaped charge case 1302 having a back wall 1322 and at least one side wall 1324. According to an aspect, the shaped charge case 1302 further includes a hollow interior 1320 that is bounded by the back wall 1322 and the at least one side wall 1324. According to an aspect, a detonating cord receptacle 1310 extends from the back wall 1322. The detonating cord receptacle 1310 is configured to receive and guide at least a portion of a detonating cord along the back wall 1322 of the shaped charge case 1302.

An adapter 1304 is positioned in a hollow interior 1320 of the shaped charge case 1302. The adapter includes a plurality of members 1312. The plurality of members 1312 each extend along a portion of an inner surface 1314 of the shaped charge case 1302. A surface profile of each of the plurality of members 1312 is contoured to conform to a contour of the inner surface 1314 of the shaped charge case 1302. Each member of the plurality of members 1312 include a first surface 1326 and a second surface 1328 spaced apart from the first surface 1326. According to an aspect, the second surface 1328 is configured to be adjacent the inner surface 1314 of the shaped charge case 1302. Each member of the plurality of members 1312 is configured to be secured to the inner surface 1314 of the shaped charge case 1302. Each member may include a securing mechanism 1318 that aids in securing the member within the hollow interior 1320. According to an aspect, each member of the plurality of members 1312 is spaced apart from each other such that the adapter 1304 has a central open area 1316.

According to an aspect, an explosive load 1306 is positioned in the shaped charge case 1302 on top of the plurality of members 1312 (i.e., the adapter 1304). Since each member of the plurality of members 1312 is spaced apart from each other, at least some of the explosive load 1306 extends along the inner surface 1314 of the shaped charge case 1302.

A liner 1308 is illustrated as being positioned on top of the explosive load 1306. The liner 1308 may be configured as a pre-pressed liner/pressed metal powder/conical liner that is disposed atop the explosive load 1306. According to an aspect, the liner 1308 is configured substantially as illustrated in FIG. 7A and described hereinabove.

Figure 14:
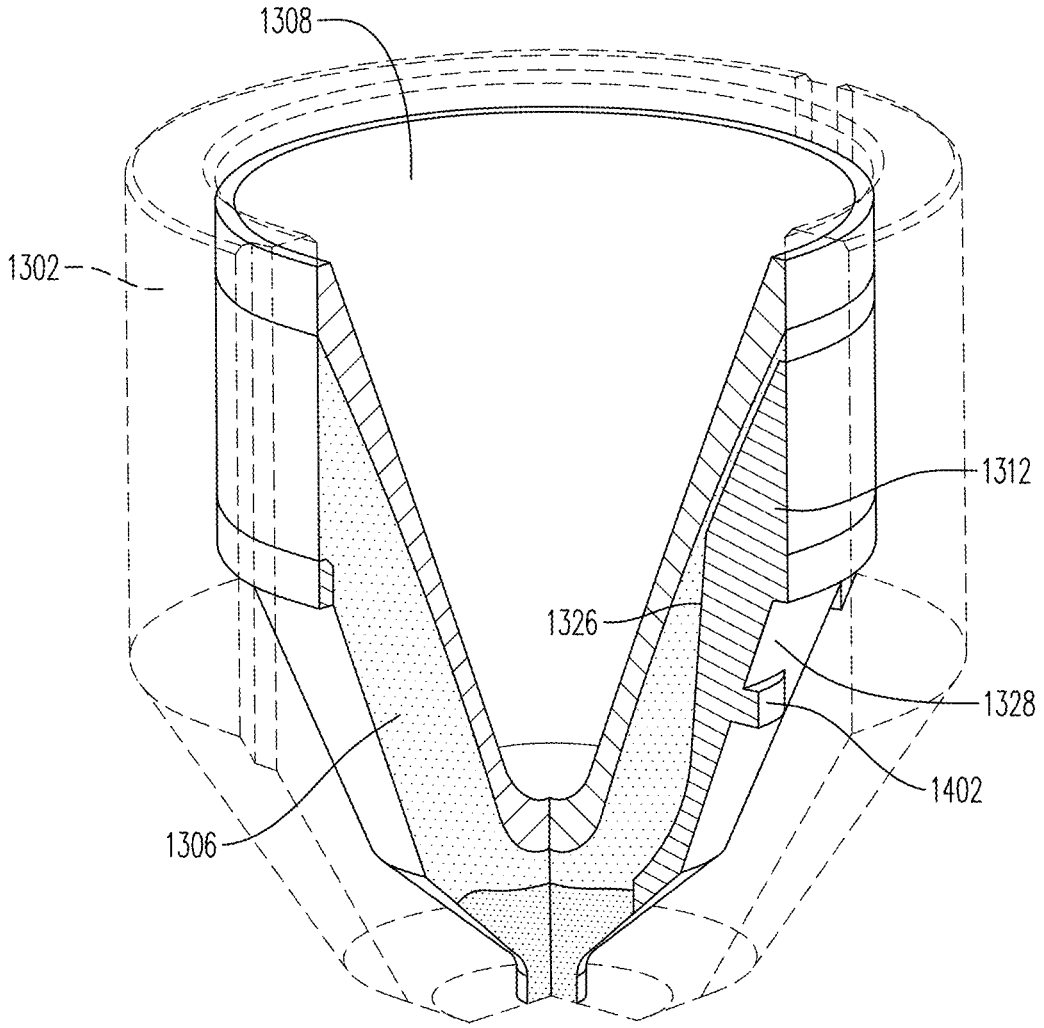
FIG. 14 is a cross-section view of a shaped charge including an adapter, according to an embodiment.

FIG. 14 illustrates a partial cutaway view of a shaped charge 1300 including the adapter 1304. In this configuration of the adapter 1304, an additional mode of securing the plurality of members 1312 in the hollow interior 1320 of the shaped charge case 1302 is shown. The additional mechanism includes a protrusion 1402 that extends outwardly from the second surface 1328 of the member. While the protrusion 1402 is illustrated in FIG. 14 as having a generally rectangular shape, it is contemplated that the protrusion 1402 may have any shape that can help to secure it in the hollow interior 1320. For example, as show in FIG. 16, the protrusion 1402 may have an elliptical shape.

Figure 15:
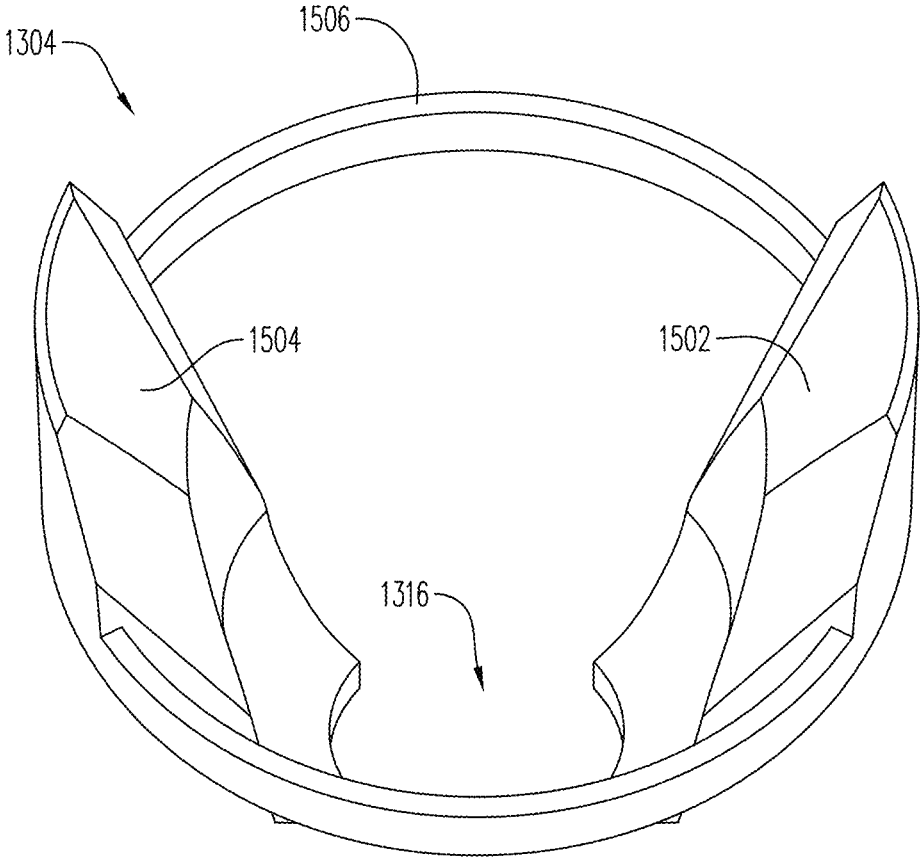
FIG. 15 is a perspective view of an adapter, according to an embodiment.

FIG. 15 is a top down, perspective view of an adapter 1304 including a ring structure. The ring structure includes a collar 1506, according to an embodiment. A pair of members 1312 are illustrated as being secured to the collar 1506 in a spaced apart configuration from each other such that the adapter 1304 includes a central open area 1316. The plurality of members 1312 may include a first member 1504 and a second member 1502. According to an aspect, the first member 1504 is spaced apart from the second member 1502 by 180 degrees, as measured in relation to a circumference of the collar 1506.

According to an aspect, a width of each of the first member 1504 and the second member 1502 spans between approximately 20 degrees to 100 degrees of a circumference of the collar 1506. According to an aspect, the total width of the first member 1504 and the second member 1502 may span about 120-degrees to about 180-degrees of a total circumference of the shaped charge case. According to an aspect, the width of each of the first member 1504 and the second member 1502 is about 5 mm to about 65 mm.

According to an aspect, the collar 1506 and the plurality of members 1312 are both secured to the inner surface 1314 of a shaped charge case 1302. According to an aspect, the collar 1506 is used to arrange or position the plurality of members 1312 of the adapter 1304 in the opposite direction from each other to help secure the adapter 1304 within the hollow interior 1320 of the shaped charge case 1302. The plurality of members 1312 of the adapter 1304 may be fixed in relation to each other, or they may be slidably positioned on the collar 1506. According to an aspect, at least one of the collar 1506 and the plurality of members 1312 are secured to the inner surface 1314 of the shaped charge case 1302 via an adhesive, clips, welding, and the like. According to an aspect, at least one of the collar 1506 and the plurality of members 1312 are secured to the inner surface 1314 of the shaped charge case 1302 via a plug connection, friction or a securing member.

The adapter 1304 is formed from an inert material that does not participate in a chemical reaction. The inert material will not participate in an exothermic chemical reaction, with the liner 240 and/or other components of the shaped charge including elements created as a result of a detonation of the shaped charge. According to an aspect, the adapter 1304 may be formed of similar materials as the adapter 100 described hereinabove.

Figure 16:
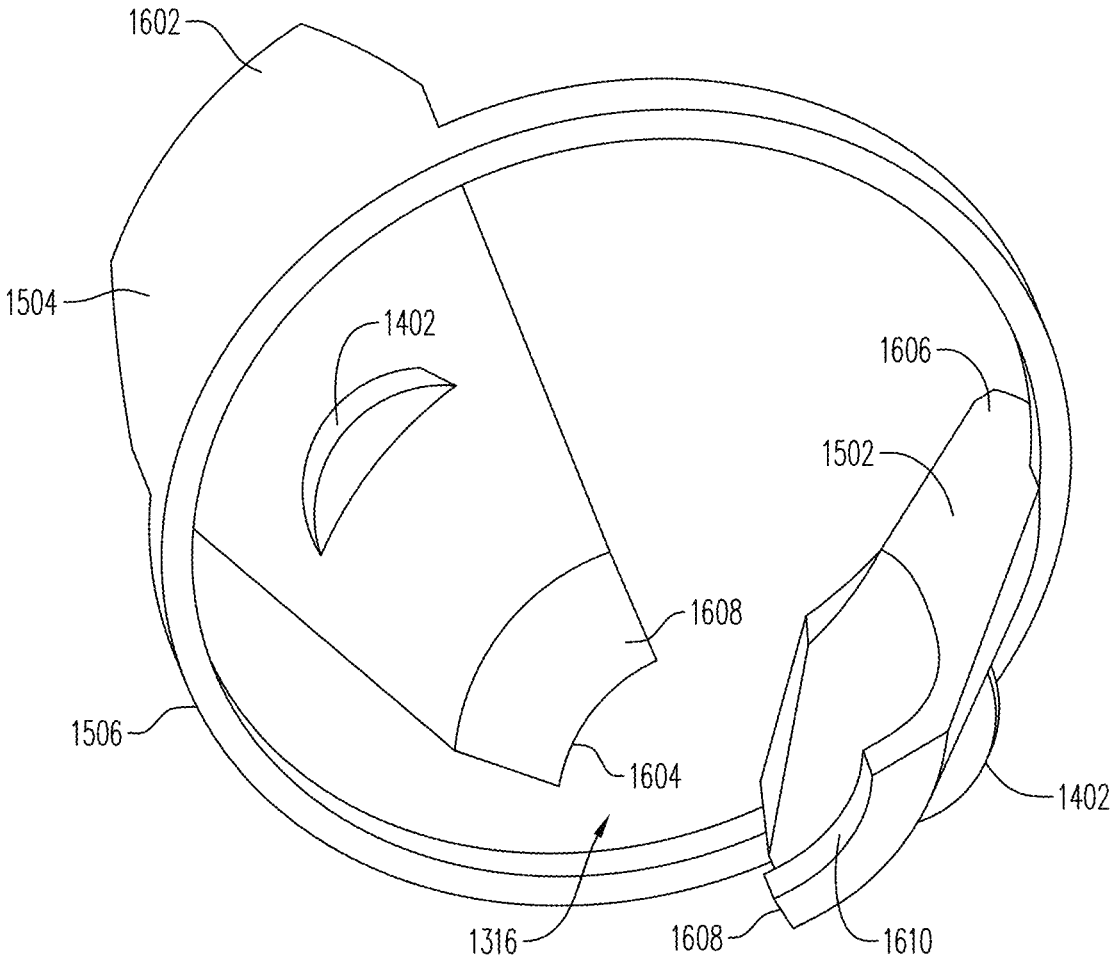
FIG. 16 is a perspective view of an adapter, illustrating keys formed thereon, according to an embodiment.

With reference to FIG. 16, which is a bottom, perspective view of the adapter 1304, the first member 1504 and the second member 1502 may each include a first end portion 1602 and a second end portion 1608 opposite and spaced apart from the first end portion 1602, with the collar extending from a substantially central portion of each of the first member 1504 and the second member 1502, between the first end portion 1602 and the second end portion 1608.

The protrusions 1402 are illustrated as extending from the second surface 1328 (FIG. 13) to help fixate the adapter 1304 in the shaped charge case 1302. Each protrusion 1402 extends in an outward direction, away from the central open area 1316. In this configuration, the protrusions 1402 engage with an inner surface 1314 of the shaped charge case 1302 illustrated in FIG. 13.

According to an aspect, each member of the plurality of members 1312 has a first end portion 1602 and a second end portion 1608 opposite and spaced apart from the first end portion 1602. The second end portion 1608 of the first member 1504 may have a contoured end 1604 and the second end portion 1608 of the second member 1502 may also have a contoured end 1610. Both contoured ends 1610, 1604 may be shaped so that they generally frame the initiation point 1702 (shown, e.g., in FIG. 18) of the shaped charge 1300 within which they are positioned. It is contemplated that this will help to ensure that appropriate detonation of the shaped charge 1300 will occur since the initiation point 1702 (FIG. 17) of the shaped charge 1300 will be in line with the explosive load 1306 disposed in the shaped charge case 1302.

Figure 17:
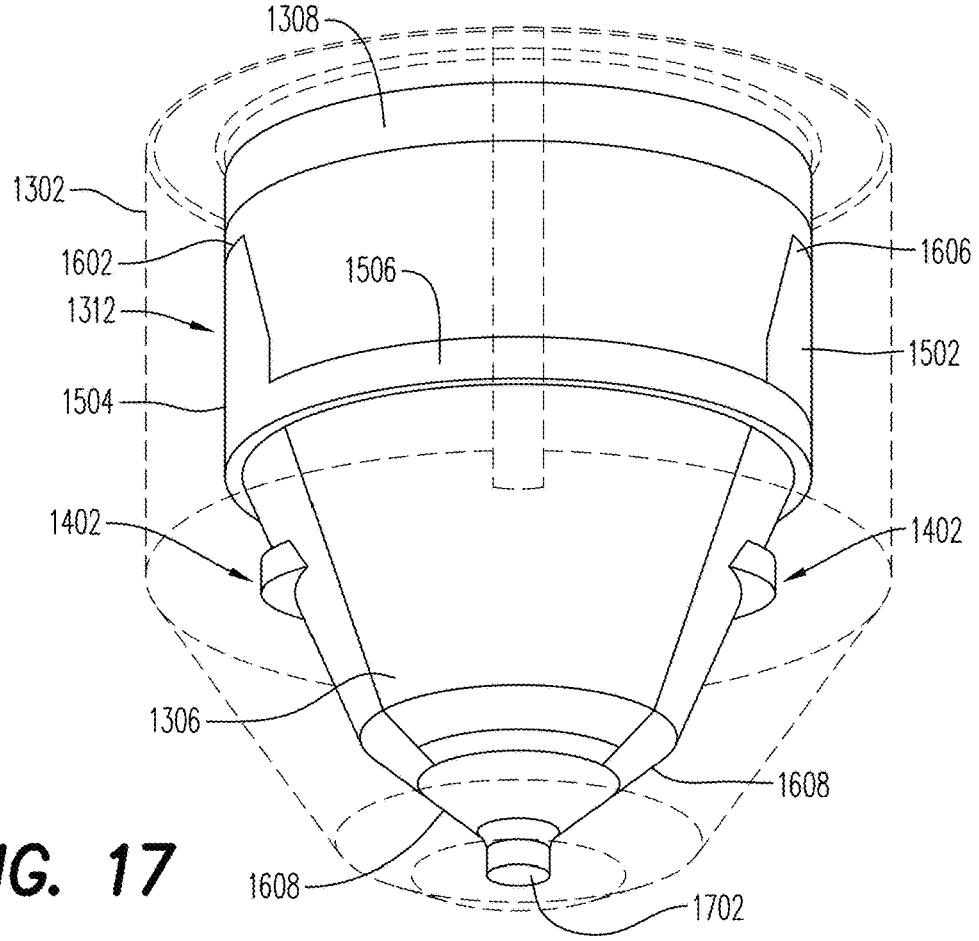
FIG. 17 is a perspective view of an adapter positioned in a shaped charge case, according to an embodiment.

FIG. 17 illustrates the adapter 1304 illustrated in FIG. 16 as being positioned and secured in the shaped charge case 1302. The contoured ends 1610, 1604 of the second end portion 1608 of the first member 1504 and the second end portion 1608 of the second member 1502 are illustrated as flanking the initiation point 1702 of the shaped charge 1300. As described herein above, this ensures that the explosive load 1306 fills the central open area 1316 and the initiation point 1702 is in contact with the explosive load 1306.

FIG. 17 also shows the collar 1506 extending between the first member 1504 and the second member 1502. The collar 1506 both joins and helps to space the first member 1504 and the second member 1502 apart from each other. While the first member 1504 and the second member 1502 are shown as being equidistantly spaced apart from each other, it is contemplated that they may be closer together on a first side of the collar 1506 than on another opposite side of the collar 1506.

Figure 18:
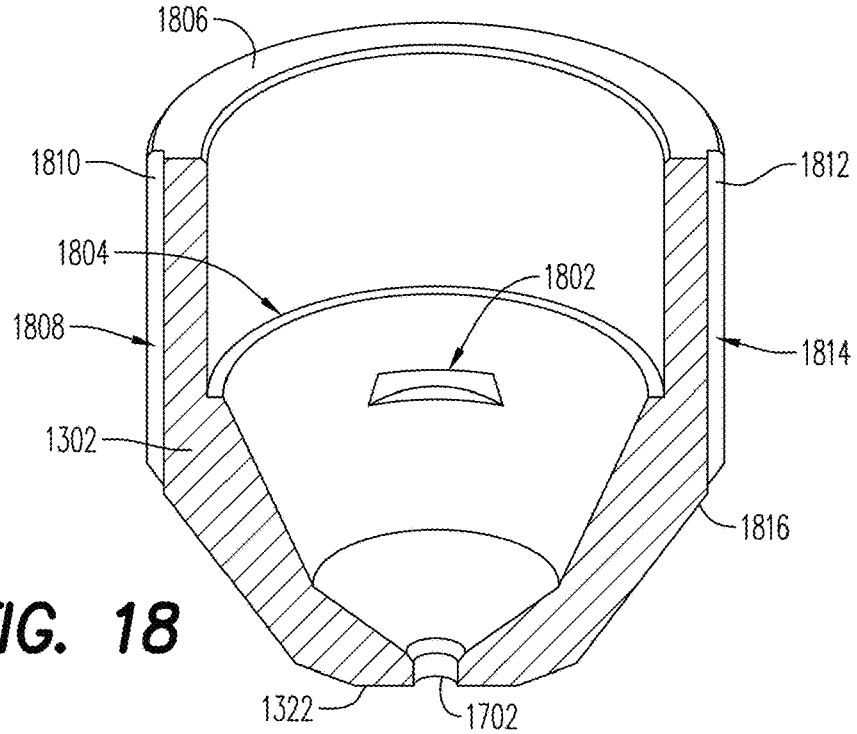
FIG. 18 is a cross-section of a shaped charge case that is modified to receive and secure an adapter within a hollow interior of the shaped charge case, according to an embodiment.

FIG. 18 illustrates that the shaped charge case 1302 may be modified to receive and secure the adapter 1304 within its hollow interior 1320. For example, each shaped charge case 1302 includes an internal surface feature 1802. The internal surface feature 1802 may be configured as an indentation or groove formed in the inner surface 1314 of the shaped charge case 1302. According to an aspect, the internal surface feature 1802 is a dug-out portion of the inner surface 1314 of the shaped charge case 1302 or it may be formed during the process of forming the shaped charge case 1302.

As described hereinabove and illustrated at least in FIG. 17, the securing mechanisms 1318 may extend outwardly from the second surface 1328 of the plurality of members 1312 to engage the internal surface feature 1802. In other words, the internal surface features 1802 may be configured to receive the protrusions 1402 of the adapter 1304. The internal surface features 1802 may serve as the lock-in points for the protrusions 1402. According to an aspect, the internal surface feature 1802 may be configured a receptacles for the securing mechanisms 1318. The internal surface feature 1802 may be configured as at least one of a dimple, a hole and a slotted opening.

According to an aspect, the internal surface features 1802 may include a shoulder or ledge 1804 upon which the collar 1506 of the adapter 1304 is positioned. The ledge 1804 may be configured to serve as a stop point for the placement of the adapter 1304 in the hollow interior 1320 of the shaped charge case 1302. This may help to ensure that the plurality of members 1312 do not get over-inserted into the hollow interior 1320 of the shaped charge case 1302.

Figure 19:
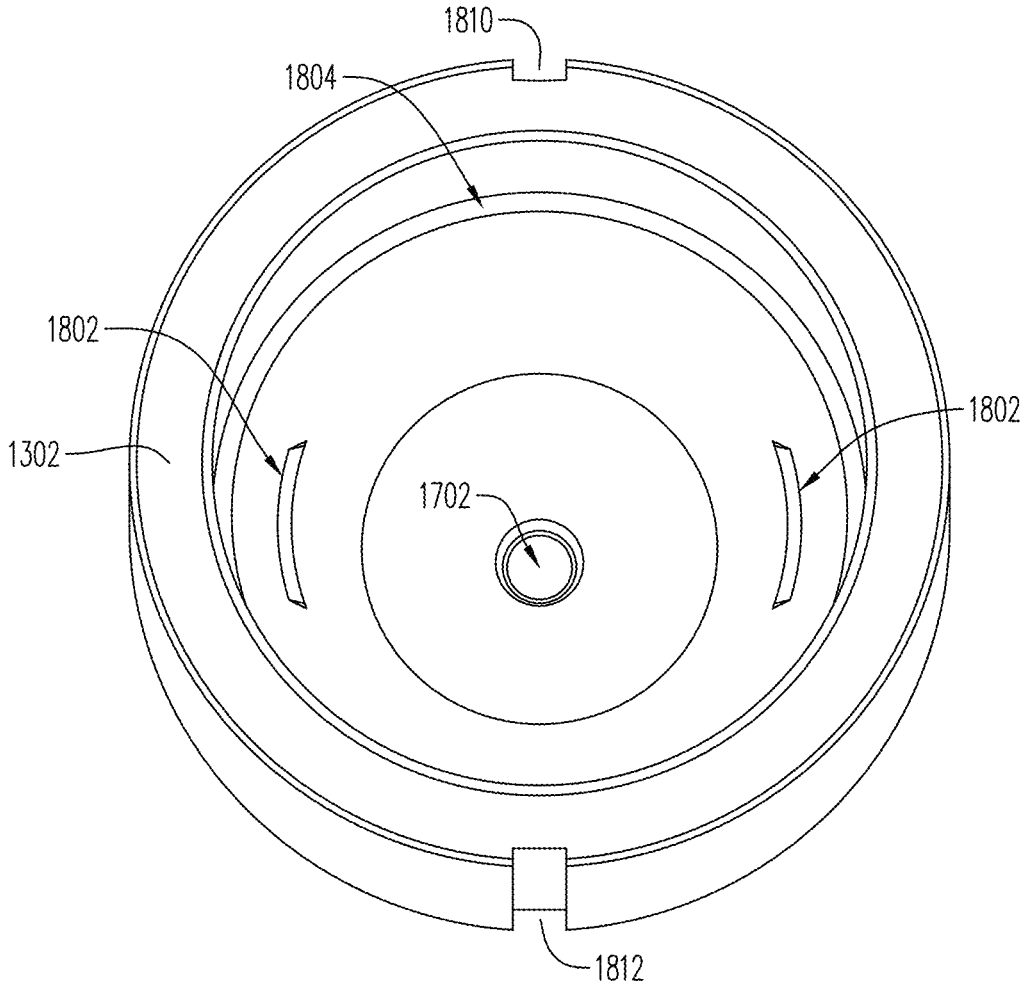
FIG. 19 is a top-down view of the shaped charge case of FIG. 18.

As illustrated in FIG. 19, the initiation point 1702 is an opening that is bored through the shaped charge case 1302. The initiation point 1702 may be a space in the back wall 1322 of the shaped charge case 1302 that was formed during the manufacturing process. According to an aspect, the initiation point 1702 may include a dug out portion of the back wall 1322 of the shaped charge case 1302. The internal surface features 1802 are illustrated as receptacles shaped as ellipsis that are configured to receive the securing mechanisms 1318 of the adapter 1304.

Figure 20:
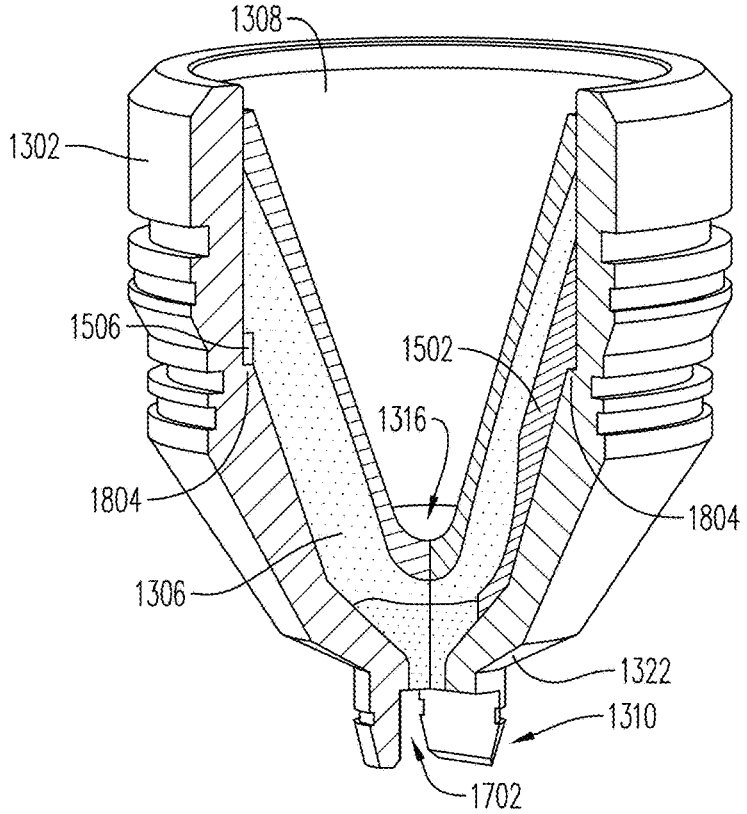
FIG. 20 is a cross-section view of a shaped charge including an adapter and a detonating cord receptacle arranged about the initiation point of the shaped charge, according to an embodiment.

FIG. 20 is a partial cut-away view of a shaped charge 1300 having an inner surface 1314 that defines a hollow interior 1320 of the shaped charge case. According to an aspect, the shaped charge 1300 includes an adapter 1304 coupled to the inner surface of the shaped charge case 1302. The adapter 1304 includes a plurality of members (see, for example, first member 1504) secured to the inner surface in a spaced apart configuration from each other, such that the adapter has a central open area 1316. Each adapter may be coupled to or otherwise extend from a collar 1506.

An explosive load 1306 is disposed within the hollow interior 1320 atop the adapter 1304, such that the explosive load 1306 covers a substantial portion or all of the adapter 1304 and is in direct contact with a portion of the inner surface 1314 of the shaped charge case 1302. According to an aspect, the explosive load 1306 is configured to produce a perforating jet upon detonation of the shaped charge 1300. As illustrated in FIG. 20, the shaped charge 1300 may also include a liner 1308 disposed on top of the explosive load 1306. At least a portion of the adapter 1304 displaces some of the explosive load 1306 such that, upon detonation of the shaped charge 1300, a perforation with an atypical geometry based at least in part by shape of the shaped charge case 1302 and the shape of the liner 1308, is produced.

The shaped charge case includes a detonating cord receptacle 1310 arranged about the initiation point of shaped charge case 1302. According to an aspect, the detonating cord receptacle 1310 includes a first cord slot 1810 (FIG. 21) for receiving and arranging at least a portion of a detonating cord along the initiation point 1702 and routing the detonating cord within a perforating gun housing.

Figure 21:
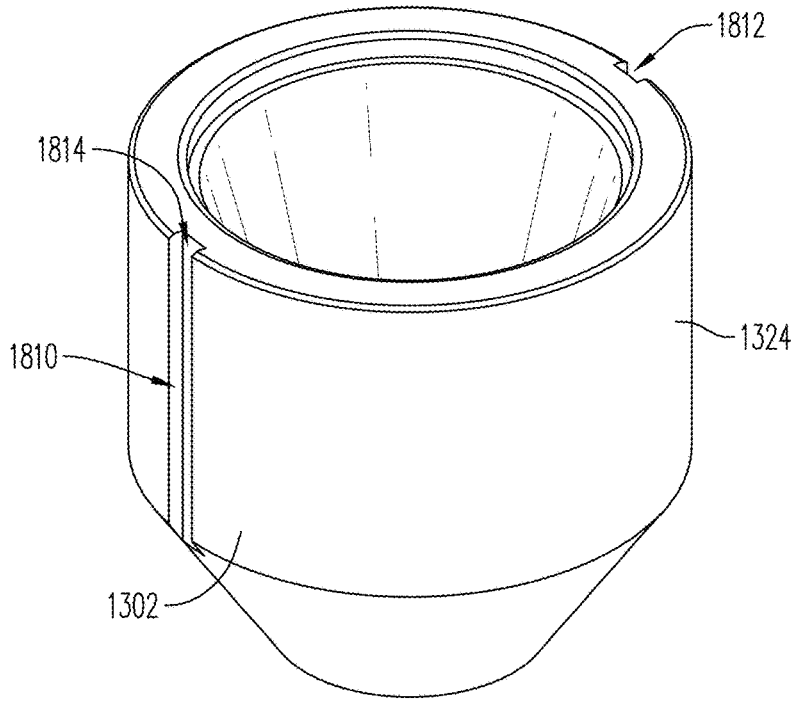
FIG. 21 is a perspective view of a shaped charge case with a modified detonating cord receptacle, according to an embodiment.

FIG. 21 is a perspective view of a shaped charge case including a guide 1814 formed in the outer surface of the shaped charge case 1302. According to an aspect, the guide 1814 extends along the side wall 1324 (FIG. 13) of the shaped charge case 1302 and is configured to receive at least a portion of the detonating cord. The guide 1814 may include a groove that is parallel to a longitudinal axis of the shaped charge case 1302. According to an aspect, the guide 1814 may include at least two guides 1814. The at least two guides 1814 are spaced apart from each other so that they provide alternate routes for placement and positioning of a detonating cord. For example, FIG. 21 illustrates the guides 1814 being two (2) spaced apart grooves 1810, 1812 formed in the external surface of the shaped charge case 1302. While the grooves 1810, 1812 are shown as being equidistantly spaced, other arrangements are contemplated.

Figure 22:
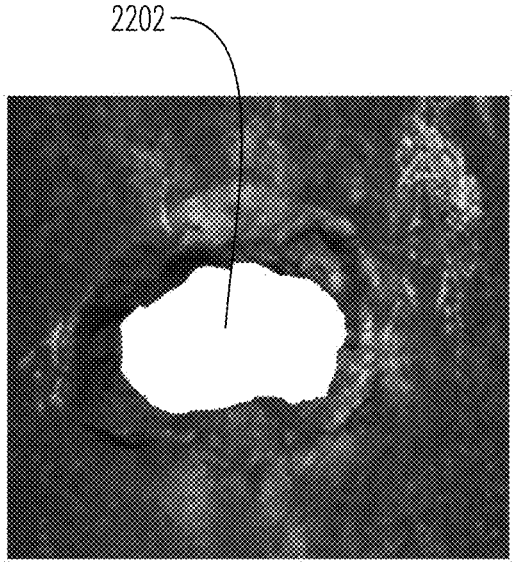
FIG. 22 illustrates a perforation hole formed with a shaped charge including an adapter, according to an embodiment.

FIGS. 22-26 illustrate views of perforation holes that may be formed with a shaped charge including an adapter. FIG. 22 illustrates a perforation that is not a typical round hole, but is that of an atypical perforation 2202 that was generated upon detonation of a conical shaped charge.

Figure 23:
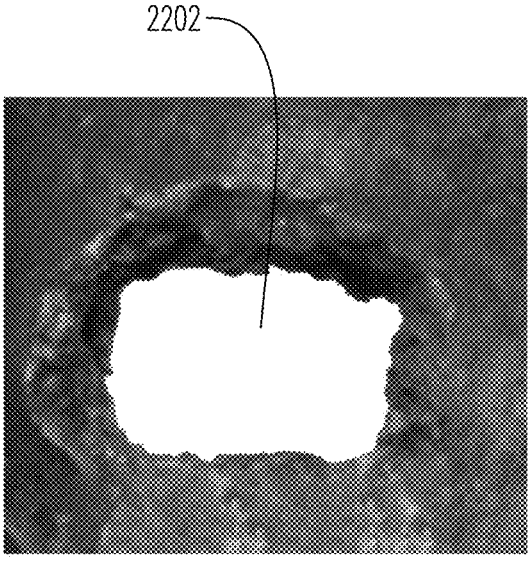
FIG. 23 illustrates a perforation hole formed with a shaped charge including an adapter, according to an embodiment.

FIG. 23 illustrates a generally rectangular or slotted atypical perforation 2202 generated upon detonation of a conical shaped charge.

Figure 24:
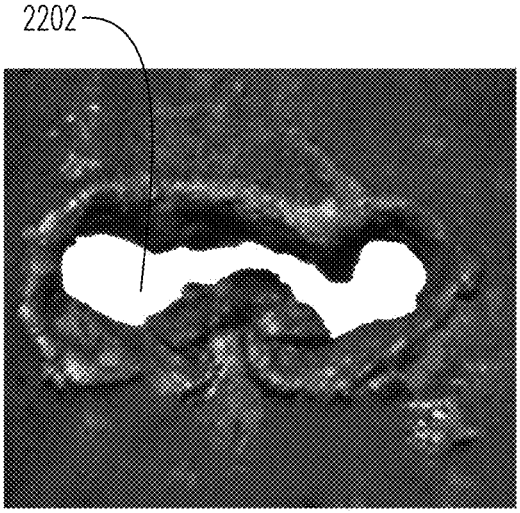
FIG. 24 illustrates a perforation hole formed with a shaped charge including an adapter, according to an embodiment.

FIG. 24 illustrates a generally square atypical perforation 2202 generated upon detonation of a conical shaped charge.

Figure 25:
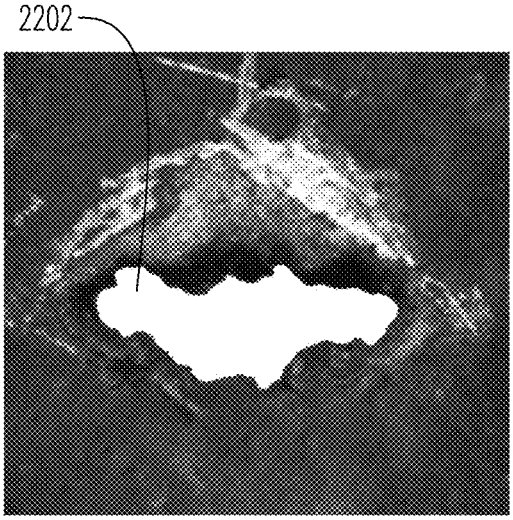
FIG. 25 illustrates a perforation hole formed with a shaped charge including an adapter, according to an embodiment.

FIG. 25 illustrates a generally rectangular-shape atypical perforation 2202 generated upon detonation of a conical shaped charge.

It is further contemplated that due to the displacement of explosive load by the adapter and/or the reduced amount of explosive load in the shaped charge case due to the presence of the adapter, the potential gun swell of perforating guns that include a modified shaped charge (in accordance with the disclosure herein) is smaller than the gun swell that is seen with standard shaped charges. This may be particularly beneficial on wells with limitations to the perforating gun housing's outer diameter.

The present disclosure, in various embodiments, configurations and aspects, includes components, methods, processes, systems and/or apparatus substantially developed as depicted and described herein, including various embodiments, sub-combinations, and subsets thereof. Those of skill in the art will understand how to make and use the present disclosure after understanding the present disclosure. The present disclosure, in various embodiments, configurations and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that variations in these ranges will suggest themselves to a practitioner having ordinary skill in the art and, where not already dedicated to the public, the appended claims should cover those variations.

The terms "determine", "calculate" and "compute," and variations thereof, as used herein, are used interchangeably and include any type of methodology, process, mathematical operation or technique.

The foregoing discussion of the present disclosure has been presented for purposes of illustration and description. The foregoing is not intended to limit the present disclosure to the form or forms disclosed herein. In the foregoing Detailed Description for example, various features of the present disclosure are grouped together in one or more embodiments, configurations, or aspects for the purpose of streamlining the disclosure. The features of the embodiments, configurations, or aspects of the present disclosure may be combined in alternate embodiments, configurations, or aspects other than those discussed above. This method of disclosure is not to be interpreted as reflecting an intention that the present disclosure requires more features than are expressly recited in each claim. Rather, as the following claims reflect, the claimed features lie in less than all features of a single foregoing disclosed embodiment, configuration, or aspect. Thus, the following claims are hereby incorporated into this Detailed Description, with each claim standing on its own as a separate embodiment of the present disclosure.

Advances in science and technology may make equivalents and substitutions possible that are not now contemplated by reason of the imprecision of language; these variations should be covered by the appended claims. This written description uses examples to disclose the method, machine and computer-readable medium, including the best mode, and also to enable any person of ordinary skill in the art to practice these, including making and using any devices or systems and performing any incorporated methods. The patentable scope thereof is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A shaped charge comprising:

a shaped charge case comprising an inner surface and an outer surface, wherein the inner surface defines a hollow interior of the shaped charge case;

an adapter coupled to the inner surface of the shaped charge case, the adapter comprising:

a collar; and a plurality of members secured to the collar in a spaced apart configuration from each other such that the adapter has a central open area;

an explosive load disposed within the hollow interior atop the adapter, such that the explosive load covers the adapter and is in direct contact with a portion of the inner surface of the shaped charge case; and a liner disposed adjacent the explosive load, wherein at least a portion of the adapter displaces some of the explosive load, and the displaced explosive load is configured to accelerate the liner to produce a perforating jet upon detonation of the shaped charge such that the adapter is configured to produce an atypical perforation hole geometry in a target.

2. The shaped charge of claim 1, wherein the plurality of members comprises:

a first member; and a second member, wherein the first and second members are spaced 180 degrees from each other on the collar.

3. The shaped charge of claim 2, wherein a width of each of the first member and the second member spans between approximately 20 degrees to 100 degrees of a circumference of the collar.

4. The shaped charge of claim 1, wherein each of the plurality of members comprise a first end and a second end opposite and spaced apart from the first end, wherein the collar is secured to a substantially central portion of each of the members between the first and second ends.

5. The shaped charge of claim 4, wherein, in each member of the plurality of members, a thickness of the first end is less than a thickness of the corresponding substantially central portion.

6. The adapter of claim 4, wherein, in each member of the plurality of members, a thickness of the second end is less than a thickness of the corresponding substantially central portion.

7. The adapter of claim 4, wherein, in each member of the plurality of members, a thickness of the substantially central portion is greater than a thickness of the first end and greater than a thickness of the second end.

8. The shaped charge of claim 1, wherein a surface profile of each of the plurality of members is contoured to conform to a contour of the inner surface of the shaped charge case.

9. The shaped charge of claim 1, wherein the adapter is formed from a plastic material.

* * * * *